US005726005A

United States Patent [19]

Chen et al.

[11] Patent Number: 5,726,005

[45] Date of Patent: Mar. 10, 1998

[54] PHOTOGRAPHIC PRINT ELEMENTS CONTAINING CUBICAL GRAIN SILVER IODOCHLORIDE EMULSIONS

[75] Inventors: Benjamin Teh-Kung Chen, Penfield; James Lawrence Edwards; Roger Lok, both of Rochester; Sanford Howard Ehrlich, Pittsford, all of N.Y.

[73] Assignee: Eastman Kodak Company, Rochester, N.Y.

[21] Appl. No.: 649,391

[22] Filed: May 17, 1996

Related U.S. Application Data

[63] Continuation-in-part of Ser. No. 362,283, Dec. 22, 1994, abandoned.

[51] Int. Cl.[6] ..... G03C 1/035; G03C 1/34

[52] U.S. Cl. ..... 430/567; 430/569; 430/607; 430/611; 430/613; 430/614

[58] Field of Search ..... 430/567, 569, 430/607, 611, 613, 614

[56] References Cited

U.S. PATENT DOCUMENTS

| | | | |
|---|---|---|---|
| 4,269,927 | 5/1981 | Atwell | 430/569 |
| 4,865,962 | 9/1989 | Hasebe et al. | 430/567 |
| 5,252,454 | 10/1993 | Suzumoto et al. | 430/567 |
| 5,252,456 | 10/1993 | Ohshima et al. | 430/605 |
| 5,264,337 | 11/1993 | Maskasky | 430/567 |
| 5,275,930 | 1/1994 | Maskasky | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,389,508 | 2/1995 | Takada et al. | 430/426 |
| 5,413,904 | 5/1995 | Chang et al. | 430/569 |
| 5,547,827 | 8/1996 | Chen et al. | 430/567 |
| 5,550,013 | 8/1996 | Chen et al. | 430/567 |
| 5,605,789 | 2/1997 | Chen et al. | 430/567 |

FOREIGN PATENT DOCUMENTS

| | | | |
|---|---|---|---|
| 0 295 439 | 12/1988 | European Pat. Off. | G03C 1/02 |
| 0 432 834 A1 | 6/1991 | European Pat. Off. | G03C 1/035 |
| 0 543 403-A1 | 5/1993 | European Pat. Off. | G03C 5/50 |
| 1-304448 | 12/1989 | Japan | 430/567 |
| 3 084 545 | 4/1991 | Japan | G03C 7/20 |

OTHER PUBLICATIONS

*Research Disclosure*, vol. 365, Sep. 1994, Item 36544.

*Primary Examiner*—Mark F. Huff
*Attorney, Agent, or Firm*—Carl O. Thomas

[57] ABSTRACT

A photographic print element is disclosed having a reflective support and at least one image recording emulsion layer unit containing cube-like silver iodochloride grains containing from 0.05 to 3 mole percent iodide, based on total silver, in a controlled, non-uniform iodide distribution forming a core, an iodide-free surface shell having a thickness of greater than 50 Å, and a sub-surface shell that contains a maximum iodide concentration.

23 Claims, No Drawings

PHOTOGRAPHIC PRINT ELEMENTS CONTAINING CUBICAL GRAIN SILVER IODOCHLORIDE EMULSIONS

This is a continuation-in-part of Applicants' patent application, U.S. Ser. No. 08/362,283, filed Dec. 22, 1994, now abandoned.

FIELD OF THE INVENTION

The invention is directed to photographic print element containing radiation-sensitive silver halide emulsions.

DEFINITION OF TERMS

The term "high chloride" in referring to silver halide grains and emulsions is employed to indicate an overall chloride concentration of at least 90 mole percent, based on total silver.

In referring to grains and emulsions containing two or more halides, the halides are named in their order of ascending concentrations.

Grains and emulsions referred to as "silver bromochloride" or "silver iodochloride" can, except as otherwise indicated, contain impurity or functionally insignificant levels of the unnamed halide (e.g., less than 0.5M %, based on total silver).

The term "cubic grain" is employed to indicate a grain is that bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "tabular grain" is employed to indicate a grain structure in which the spacing between the two largest parallel crystal faces of the grain is less than half the spacing between any other pair of parallel crystal faces.

The term "tabular grain emulsion" is employed to indicate an emulsion in which at least 35 percent of total grain projected area is accounted for by tabular grains.

Mean grain sizes are reported, except as otherwise stated, in terms of mean equivalent cubic edge lengths, which are the edge lengths of cubes having the same mean grain volume as the grains sized. When grain sizes are reported in terms of equivalent circular diameter (ECD), the diameter of a circle having the same area as grain projected area, mean grain size is reported as mean ECD.

Monodisperse grain populations and emulsions are those in which the coefficient of variation of grain sizes is less than 35 percent.

Photographic speed was measured at a density of 1.0. Relative speed is reported in relative log units and therefore referred to as relative log speed. For example, a relative log speed difference of 30 relative log units=0.30 log E, where E is exposure in lux-seconds.

The term "total silver" is used to indicate all of the silver forming an entire grain or an entire grain population. Other references to "silver" refer to the silver forming the relevant portion of the grain structure—i.e., the region, portion, zone or specific location under discussion.

*Research Disclosure* is published by Kenneth Mason Publications, Ltd., Dudley House, 12 North St., Emsworth, Hampshire P010 7DQ, England.

BACKGROUND

Iodide is known to be useful in silver halide emulsions and is extensively employed in high (>50M %, based on total silver) bromide silver halide emulsions. There are two common techniques for introducing iodide uniformly or non-uniformly into silver halide grains during precipitation. In the most common technique iodide ion is added in the form of a soluble salt, such as an alkali or alkaline earth iodide salt. As an alternative source of iodide ions, the fine silver iodide grains of a Lippmann emulsion can be ripened out. Still another approach, recently advocated, illustrated by Takada et al U.S. Pat. No. 5,389,508, is to cleave iodide ions from an organic molecule present in the dispersing medium of a silver halide emulsion. Unfortunately, the conditions taught by Takada et al to cleave iodide ions significantly increase fog in high chloride emulsions. A general summary of teachings of silver halide grain compositions, including iodide and iodide placement, is provided by *Research Disclosure*, Vol. 365, September 1994, Item 36544, I. Emulsion grains and their preparation, A. Grain halide composition. Silver halide grain compositions, including iodide and iodide placement, that can satisfy minimum acceptable performance standards for market acceptance vary widely, depending upon the specific photographic application.

In its most commonly practiced form silver halide photography employs a taking film in a camera to produce, when photographically processed, a negative image on a transparent film support. A positive image for viewing is produced by exposing a photographic print element containing one or more silver halide emulsion layers coated on a reflective white support through the negative image in the taking film and photographically processing. In a relatively recent variation negative image information is retrieved by scanning and later used to expose imagewise the emulsion layer or layers of the photographic print element.

Silver chloride emulsions were an early selection for forming the image to be viewed in a photographic print element. One of the most stringent requirements for photographic print elements is low minimum density (fog), since levels of minimum density fully acceptable in taking films are objectionable when viewed against a white reflective support. Silver chloride emulsions are capable of satisfying this stringent requirement of print elements. Two additional principal advantages of silver chloride emulsions as compared to photographic emulsions of other halide compositions are (a) much faster rates of photographic processing and (b) reduced quantities and better ecological compatibility of processing effluent. Still another advantage of silver chloride emulsions is that they are readily precipitated in the form of monodisperse cubical grains, thereby realizing the known photographic advantages of grain monodispersity, including higher contrast and improved overall control of grain performance. A principal disadvantage of silver chloride emulsions is that their sensitivity is lower than that of other photographically useful silver halide emulsions.

To offset this principal disadvantage of silver chloride emulsions the art has shifted from employing silver chloride emulsions in photographic print elements to employing high chloride emulsions in which a significant amount of bromide is incorporated in the latent image forming silver halide grains. The presence of bromide in the grains increases the sensitivity of the emulsions to a limited extent, but at the expense of reducing advantages (a) and (b). In addition, the incorporation of bromide in the high chloride grains in the manner that has been observed to produce the largest observed bromide enhancements of photographic sensitivity, has both complicated and slowed the preparation and sensitization of high chloride emulsions. The presence of bromide has also frequently shifted the grain shapes from cubic to other cubical (e.g., tetradecahedral) forms, but this has not been found objectionable, since grain monodispersity has remained attainable.

The following are representative of the prior state of the art:

Hasebe et al U.S. Pat. No. 4,865,962 (a) provides regular, but not necessarily cubical, grains that are at least 50 (preferably at least 90) mole percent chloride, (b) adsorbs an organic compound to the grain surfaces and (c) introduces bromide, thereby achieving halide conversion (bromide ion displacement of chloride) at selected grain surface sites.

Asami EPO 0 295 439 discloses the addition of bromide to achieve halide conversion at the surface of silver bromochloride grains that have, prior to halide conversion, a layered structure with the surface portions of the grains having a high chloride concentration. The grains are preferably monodisperse.

Suzumoto et al U.S. Pat. No. 5,252,454 discloses silver bromochloride emulsions in which the chloride content is 95 (preferably 97) mole percent or more. The grains contain a localized phase having a bromide concentration of at least 20 mole percent preferably formed epitaxially at the surface of the grains. The grains are preferably monodisperse.

Ohshima et al U.S. Pat. No. 5,252,456 discloses silver bromochloride emulsions in which the chloride content is at least 80 (preferably 95) mole percent chloride, with a bromide rich phase containing at least 10 mole percent bromide formed at the surface of the grains by blending a fine grain emulsion with a larger, host (preferably cubic or tetradecahedral) grain emulsion and Ostwald ripening.

A common theme that runs through the teachings of Hasebe et al, Asami, Suzumoto et al and Ohshima et al is the absence of any constructive role to be played by iodide incorporation. The following statement by Asami is representative:

> In this present invention, the term essentially free of silver iodide signifies that the silver iodide content is not more than 2 mol % of the total silver content. The silver iodide content is preferably not more than 0.2 mol % and, most desirably, there is no silver iodide present at all.

None of the cited teachings go beyond the nominal acknowledgment that low levels of iodide are tolerable.

Although silver iodochloride emulsions have been broadly recognized to exist and "silver iodochloride" often appears in listings of theoretically possible silver halide compositions, silver iodochloride emulsions have, in fact, few art recognized practical applications and, as indicated by the cited teachings above, represent a grain composition that has been generally avoided.

An event of scientific interest has been the discovery reported by House et al U.S. Pat. No. 5,320,938 that high chloride emulsions can be precipitated with a significant population of tabular grains bounded by {100} major crystal faces when grain nucleation is undertaken in the presence of iodide. House et al acknowledges that the grains include a mixture of tabular grains, cubic grains and rods. Further, the tabular grains themselves show significant variances in size. House et al does not disclose any monodisperse emulsions.

Maskasky U.S. Pat. Nos. 5,264,337 and 5,292,632 (hereinafter referred to as Maskasky I and II) report the preparation of high chloride {100} tabular grain emulsions that are internally free of iodide at the site of grain nucleation, but that can tolerate iodide in the late stages of precipitation. To obtain tabular grain structures adsorbed organic restraining agents must be employed. The adsorbed restraining agents complicate emulsion preparation and can, of course, degrade and/or complicate later photographic utilization of the emulsions. Like House, Maskasky I and II precipitate mixtures of different grain shapes and do not disclose any monodisperse emulsions.

Maskasky U.S. Pat. No. 5,275,930 (hereinafter referred to as Maskasky III) discloses the chemical sensitization of the emulsions of House et al and Maskasky I and II by epitaxial deposition onto the corners of the tabular grains. Maskasky III states that the "addition of bromide ion or a combination of bromide ion and a lower proportion of iodide ion during precipitation is capable of producing preferred silver halide epitaxial depositions at the corners of the host tabular grains".

Brust et al U.S. Pat. No. 5,314,798 prepares tabular grain emulsions as taught by House et al and Maskasky I and II, but with the inclusion of a band containing a higher level of iodide than a core on which the band is precipitated. The band structures can contain up to 30 percent of the silver forming the tabular grains.

Like House et al and Maskasky I and II, Maskasky III and Brust et al form emulsions with a variety of grain shapes in addition to the tabular grains sought. Further, the tabular grains themselves show significant variances in their grain sizes. No monodisperse emulsions are disclosed.

Chang et al U.S. Pat. No. 5,413,904 improved on the precipitation process of House et al. Shifting iodide introduction from grain nucleation to immediately following grain nucleation, the formation of nontabular grains is largely eliminated. Chang et al makes no claim of grain monodispersity and the drawings, in fact, show that the tabular grains exhibit significant size variances.

Lok and Chen U.S. Pat. No. 5,547,827 discloses emulsions of the type included in the print elements of the invention further containing a quinone.

Lok and Chen U.S. Pat. 5,605,789 discloses emulsions of the type included in the print elements of the invention further containing an iodonium salt.

Lok and Chen U.S. Pat. No. 5,550,013 discloses emulsions of the type included in the print elements of the invention further containing a polyethylene oxide.

RELATED PATENT APPLICATIONS

Edwards et al U.S. Ser. No. 08/650,072, filed May 17, 1996, as a continuation-in-part of now abandoned U.S. Ser. No. 08/362,109, filed Dec. 2, 1994, commonly assigned, titled PHOTOGRAPHIC PRINT ELEMENTS CONTAINING CUBICIAL GRAIN SILVER IODOCHLORIDE EMULSIONS, discloses photographic print elements of enhanced speed and controlled minimum densities provided by emulsion layer units that contain emulsions that are blends of (a) cubical silver iodochloride grains containing from 0.05 to 3 mole percent iodide, based on total silver, in a controlled, non-uniform iodide distribution forming a core containing at least 50 percent of total silver, an iodide-free surface shell having a thickness of greater than 25 Å, and a sub-surface shell that contains a maximum iodide concentration and (b) minimum density controlling silver halide grains that are of smaller mean grain size than the silver iodochloride grains and that consist essentially of chloride and/or bromide.

Lok and Chen U.S. Ser. No. 362,107, filed Dec. 22, 1994, commonly assigned, titled HIGH CHLORIDE EMULSION HAVING HIGH SENSITIVITY AND LOW FOG, discloses emulsions of the type included in the print elements of the invention further containing a thiosulfonate.

Chen et al U.S. Ser. No. 08/651,193, filed concurrently herewith and commonly assigned, titled CUBICAL GRAIN SILVER IODOCHLORIDE EMULSIONS AND PROCESSES FOR THEIR PREPARATION, discloses radiation sensitive emulsions comprised of a dispersing medium and silver iodochloride grains wherein the silver iodochloride grains are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide-free surface shell, and a sub-surface shell that contains a maximum iodide concentration and provides, when the emulsion is exposed to 390 nm electromagnetic radiation at 10° K, exhibits stimulated fluorescent emissions in the range of from 450 to 470 nm and at 500 nm, the stimulated fluorescent emission in the range of from 450 to 470 nm having a peak intensity more than twice the stimulated fluorescent emission intensity at 500 nm.

SUMMARY OF THE INVENTION

It is an object of the invention to provide photographic print elements containing silver halide emulsions that retain the advantages of (1) low minimum densities, (2) rapid photographic processing capability and (3) ecological compatibility, known to be achievable with high chloride emulsions, while increasing their sensitivity.

It is another object of the invention to provide photographic print elements that exceed the highest sensitivity levels heretofore realized in print elements relying on cubical grain high chloride emulsions for imaging.

It is a specific object of the invention to provide photographic print elements containing silver iodochloride emulsions that exceed the sensitivity levels of the high chloride silver bromochloride emulsions currently in use in viewable print photographic elements with the further advantage that the iodochloride emulsions are simpler and faster to prepare and sensitize than the high chloride silver bromochloride emulsions.

It is another specific object to provide photographic print elements that exhibit little or no variance in sensitivity as a function of varied exposure temperatures within common ambient temperature ranges.

It is still another specific object to provide photographic print elements that are relatively pressure insensitive—this is, show reduced variations in density as a function of locally applied pressure.

It is an additional object to provide a photographic print element that exhibits low levels of high intensity reciprocity failure, allowing high intensity exposures and a wide latitude of exposure intensities.

In one aspect this invention is directed to a photographic print element comprised of a reflective support and, coated on the support, at least one image recording emulsion layer unit containing a radiation-sensitive emulsion comprised of a dispersing medium and silver iodochloride grains wherein the silver iodochloride grains are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide free surface shell having a thickness of greater than 50 Å, and a sub-surface shell that contains a maximum iodide concentration.

DESCRIPTION OF PREFERRED EMBODIMENTS

The photographic print elements of the invention are comprised of a reflective support and, coated on the support, at least one radiation-sensitive cubical grain high chloride imaging emulsion.

Whereas those preparing high chloride emulsions for print elements have previously relied upon bromide incorporation for achieving enhanced sensitivity and have sought to minimize iodide incorporation, the emulsions of the present invention contain cubical silver iodochloride grains. The silver iodochloride cubical grain emulsions of the invention exhibit higher sensitivities than previously employed silver bromochloride cubical grain emulsions. This is attributable to the iodide incorporation within the grains and, more specifically, the placement of the iodide within the grains.

It has been recognized for the first time that heretofore unattained levels of sensitivity and other advantageous properties, such as those recited in the objects and demonstrated in the Examples below, can be realized, without offsetting degradation of photographic performance, by the controlled, non-uniformly distributed incorporation of iodide within the grains. Specifically, after at least 50 (preferably 85) percent of total silver forming the grains has been precipitated to form a core portion of the grains, a maximum iodide concentration is located within a shell that is formed on the host (core) grains, and the maximum iodide concentration containing shell is then converted to a sub-surface shell by precipitating silver and chloride ions without further iodide addition.

Although there is no theory that entirely accounts for the results observed, it is believed that the disruptive effect of iodide ions on the crystal lattice forming the grains plays an important role in obtaining increased photographic sensitivity. Since iodide ions are much larger than chloride ions, the crystal cell dimensions of silver iodide are much larger than those of silver chloride. For example, the crystal lattice constant of silver iodide is 5.0 Å compared to 3.6 Å for silver chloride. Thus, locally increasing iodide concentrations within the grains locally increases crystal lattice variances and, provided the crystal lattice variances are properly located, photographic sensitivity is increased.

The silver iodochloride grains show enhanced performance with iodide concentrations ranging from 0.05 to 3.0 mole percent, based on total silver. Preferably overall iodide concentrations range from 0.1 to 1.0 mole percent, based on total silver. More important than the overall iodide concentration within the silver iodochloride grains is the placement of the iodide.

Iodide incorporation in the core portions of the grains adds iodide with no significant enhancement of photoefficiency. To avoid unnecessarily elevating overall iodide levels, it is contemplated that the iodide concentrations in the central (core) portions of the grains in all instances be less than the maximum incorporated iodide concentration. Preferably the iodide concentration in the core portions of the grains is less than half the average overall iodide concentration and, optimally, the core is substantially free of iodide—that is, formed without intentionally adding iodide. In comparing emulsions containing the same overall levels of iodide, speed enhancements are directly related to the extent to which iodide is excluded from the central portions of the grains.

Iodide addition onto the core portions of the grains creates a silver iodochloride shell on the host (core) grains. Attempts to use these shelled grains in photographic print elements without further modification results in markedly inferior performance. Having high iodide concentrations at the surface of the grains lowers speed as compared to the emulsions satisfying the requirements of the invention when both emulsions are sensitized to the same minimum density and otherwise produces elevated levels of minimum density that are incompatible with acceptable performance characteristics of photographic reflective print elements.

To increase speed and lower minimum density an iodide-free shell is precipitated onto the silver iodochloride shell, converting it into a sub-surface shell. The depth to which sub-surface shell is buried is chosen to render the iodide in the sub-surface shell inaccessible to the developing agent at the outset of development of latent image bearing grains and inaccessible throughout development in the grains that do not contain a latent image. The thickness of the surface shell is contemplated to be greater than 50 Å in emulsions employed in reflection print photographic elements. The surface shell thickness can, of course, range up to any level compatible with the minimum core requirement of 50 (preferably 85) percent of total silver. Since the sub-surface shell can contribute as little as 0.05 mole percent iodide, based on total silver, it is apparent that surface shells can account for only slightly less than all of the silver not provided by the core portions of the grains. A surface shell accounting for just less than 50 (preferably just <15) percent of total silver is specifically contemplated.

The presence of a maximum iodide concentration in the sub-surface shell is in itself sufficient to increase photographic speed. It has been additionally observed that further enhancements in photographic speed attributable to iodide incorporation in the sub-surface shell are realized the emulsions exhibit a unique stimulated fluorescent emission spectral profile. Specifically, it has been observed that further enhanced photographic sensitivity is in evidence in emulsions that, when stimulated with 390 nm radiation at 10° K, produce a peak stimulated fluorescent emission in the wavelength range of from 450 to 470 nm that is at least twice the intensity of stimulated fluorescent emission at 500 nm (hereinafter referred to the reference emission wavelength). Emission at 500 nm is attributed to the chloride in the grains. In the absence of iodide (and hence the absence of iodide induced crystal lattice variances) the peak intensity of stimulated fluorescent emission in the wavelength range of from 450 to 470 nm is relatively low, typically less than that at the reference emission wavelength.

To achieve the crystal lattice defects that stimulate a peak fluorescent emission in the wavelength range of from 450 to 470 nmmore than twice the reference wavelength emission, only very low levels of iodide, based on total silver, are required. It is not the overall concentration of iodide that determines the fluorescent emission profile or emulsion sensitivity, but the crystal lattice defects that the iodide, when properly introduced, create. Slow iodide ion introductions that anneal out crystal lattice defects can incorporate iodide ion concentrations in excess of the minimum levels noted above without creating the stimulated emission profiles exhibited by the emulsions of the highest levels of sensitivity. The emulsion preparations of the Examples below demonstrate iodide ion incorporations that create the stimulated emission profiles and enhanced levels of sensitivity that represent preferred embodiments of this invention. Parameters that promote enhanced sensitivity are (1) increased localized concentrations of iodide, and/or (2) abrupt introductions of iodide ion during precipitation (sometimes referred to as "dump iodide" addition). When coupled with (1) and/or (2), increased overall iodide concentrations also contribute the achieving higher levels of photoefficiency increasing overall iodide concentrations without following the placement requirements of the invention can increase photographic speed, but this produces the disadvantages of elevated iodide ion incorporation that have been reported and avoided in selecting emulsions for photographic reflection print elements.

It is surprising that burying the maximum iodide phase within the grains not only is compatible with achieving higher levels of photoefficiency but actually contributes an additional increment of speed enhancement. Whereas it might be thought that shifting the maximum iodide phase to the interior of the grain would also shift the latent image internally, detailed investigations have revealed that latent image formation remains at the surface of the grains. The invention has resulted from empirical correlations of incorporated structural features and observed performance enhancements, and no theory has been devised that can fully account for performance characteristics observed.

It was initially observed that, after starting with monodisperse silver chloride cubic grains (i.e., grains consisting of six {100} crystal faces), iodide introduction produced tetradecahedral grains (i.e., , grains consisting of six {100} crystal faces and eight {111} crystal faces). Further investigations revealed that as few as one {111} crystal face are sometimes present in the completed grains. On still further investigation, it has been observed that the emulsions of the invention can be cubic grain emulsions. Thus, although the presence of at least {111} crystal face (and usually tetradecahedral grains), provides a convenient visual clue that the grains may have been prepared according to the teaching of this invention, it has now been concluded that one or more {111} crystal faces are a by-product of grain formation that can be eliminated or absent without compromising the unexpected performance advantages of the invention noted above.

The preparation of cubical grain silver iodochloride emulsions with iodide placements that produce increased photographic sensitivity can be undertaken by employing any convenient conventional high chloride cubical grain precipitation procedure prior to precipitating the region of maximum iodide concentration—that is, through the introduction of at least the first 50 (preferably at least the first 85) percent of silver precipitation. The initially formed high chloride cubical grains then serve as hosts for further grain growth. In one specifically contemplated preferred form the host emulsion is a monodisperse silver chloride cubic grain emulsion. Low levels of iodide and/or bromide, consistent with the overall composition requirements of the grains, can also be tolerated within the host grains. The host grains can include other cubical forms, such as tetradecahedral forms. Techniques for forming emulsions satisfying the host grain requirements of the preparation process are well known in the art. For example, prior to growth of the maximum iodide concentration region of the grains, the precipitation procedures of Atwell U.S. Pat. No. 4,269,927, Tanaka EPO 0 080 905, Hasebe et al U.S. Pat. No. 4,865,962, Asami EPO 0 295

439, Suzumoto et al U.S. Pat. No. 5,252,454 or Ohshima et al U.S. Pat. No. 5,252,456, the disclosures of which are here incorporated by reference, can be employed, but with those portions of the preparation procedures, when present, that place bromide ion at or near the surface of the grains being omitted. Stated another way, the host grains can be prepared employing the precipitation procedures taught by the citations above through the precipitation of the highest chloride concentration regions of the grains they prepare.

Once a host grain population has been prepared accounting for at least 50 percent (preferably at least 85 percent) of total silver has been precipitated, an increased concentration of iodide is introduced into the emulsion to form the region of the grains containing a maximum iodide concentration. The iodide ion is preferably introduced as a soluble salt, such as an ammonium or alkali metal iodide salt. The iodide ion can be introduced concurrently with the addition of silver and/or chloride ion. Alternatively, the iodide ion can be introduced alone followed promptly by silver ion introduction with or without further chloride ion introduction. It is preferred to grow the maximum iodide concentration region on the surface of the host grains rather than to introduce a maximum iodide concentration region exclusively by displacing chloride ion adjacent the surfaces of the host grains.

To maximize the localization of crystal lattice variances produced by iodide incorporation it is preferred that the iodide ion be introduced as rapidly as possible. That is, the iodide ion forming the maximum iodide concentration region of the grains is preferably introduced in less than 30 seconds, optimally in less than 10 second. When the iodide is introduced more slowly, somewhat higher amounts of iodide (but still within the ranges set out above) are required to achieve speed increases equal to those obtained by more rapid iodide introduction and minimum density levels are somewhat higher. Slower iodide additions are manipulatively simpler to accomplish, particularly in larger batch size emulsion preparations. Hence, adding iodide over a period of at least 1 minute (preferably at least 2 minutes) and, preferably, during the concurrent introduction of silver is specifically contemplated.

It has been observed that when iodide is added more slowly, preferably over a span of at least 1 minute (preferably at least 2 minutes) and in a concentration of greater than 5 mole percent, based the concentration of silver concurrently added, the advantage can be realized of decreasing grain-to-grain variances in the emulsion. For example, well defined tetradecahedral grains have been prepared when iodide is introduced more slowly and maintained above the stated concentration level. It is believed that at concentrations of greater than 5 mole percent the iodide is acting to promote the emergence of {111} crystal faces. Any local iodide concentration level can be employed up to the saturation level of iodide in silver chloride, typically about 13 mole percent. Maskasky U.S. Pat. No. 5,288,603, here incorporated by reference, discusses iodide saturation levels in silver chloride.

Further grain growth following precipitation of the maximum iodide concentration region can be undertaken by any convenient conventional technique. Conventional double-jet introductions of soluble silver and chloride salts can be precipitate silver chloride as a surface shell. Alternatively, particularly where a relatively thin surface shell is contemplated, a soluble silver salt can be introduced alone, with additional chloride ion being provided by the dispersing medium.

At the conclusion of grain precipitation the grains can take varied cubical forms, ranging from cubic grains (bounded entirely by six {100} crystal faces), grains having an occasional identifiable {111} face in addition to six {100} crystal faces, and, at the opposite extreme tetradecahedral grains having six {100} and eight {111} crystal faces.

After examining the performance of emulsions exhibiting varied cubical grain shapes, it has been concluded that the performance of these emulsions is principally determined by iodide incorporation and the uniformity of grain size dispersity. The silver iodochloride grains are relatively monodisperse. The silver iodochloride grains preferably exhibit a grain size coefficient of variation of less than 35 percent and optimally less than 25 percent. Much lower grain size coefficients of variation can be realized, but progressively smaller incremental advantages are realized as dispersity is minimized.

In the course of grain precipitation one or more dopants (grain occlusions other than silver and halide) can be introduced to modify grain properties. For example, any of the various conventional dopants disclosed in *Research Disclosure*, Vol. 365, September 1994, item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

In one preferred form of the invention it is specifically contemplated to incorporate in the face centered cubic crystal lattice of the grains a dopant capable of increasing photographic speed by forming a shallow electron trap (hereinafter also referred to as a SET). When a photon is absorbed by a grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of $Ag^o$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the grain to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled-e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt U.S. Pat. No. 2,628,167, Gilman et al U.S. Pat. No. 3,761,267, Atwell et al U.S. Pat. No. 4,269,527, Weyde et al U.S. Pat. No. 4,413,055 and Murakima et al EPO 0 590 674 and 0 563 946.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron with-drawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of ligands in the spectrochemical series is apparent:

$$I^- < Br^- < S^{-2} < SCN^- < Cl^- < NO_3^- < F^- < OH < H_2O < NCS^- < CH_3CN^- < NH_3 < NO_2^- << CN^- < CO.$$

The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion.

The efficiency of a ligand in raising the LUMO value of the dopant complex increases as the ligand atom bound to the metal changes from Cl to S to O to N to C. Thus, the ligands $CN^-$ and CO are especially preferred. Other preferred ligands are thiocyanate ($NCS^-$), selenocyanate ($NCSe^-$), cyanate ($NCO^-$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < Fe^{+2} < Cr^{+3}$$

$$>> V^{+3} < Co^{+3} < Mn^{+4} < Mo^{+3} < Rh^{+3}$$

$$>> Ru^{+3} < Pd^{+4} < Ir^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electronegative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally atmorest 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi* (b), Vol. 152 (1989), pp. 583–592, in a AgCl crystal the g factor of the electron EPR signal is 1.88±0.01 and in AgBr it is 1.49±0.02.

A coordination complex dopant can be identified as useful in forming shallow electron traps in silver halide emulsions if, in the test emulsion set out below, it enhances the magnitude of the electron EPR signal by at least 20 percent compared to the corresponding undoped control emulsion.

For a high chloride (>50M %) emulsion the undoped control is a 0.34±0.05 μm edge length AgCl cubic emulsion prepared, but not spectrally sensitized, as follows: A reaction vessel containing 5.7 L of a 3.95% by weight gelatin solution is adjusted to 46° C., pH of 5.8 and a pAg of 7.51 by addition of a NaCl solution. A solution of 1.2 grams of 1,8-dihydroxy-3,6-di-thiaoctane in 50 mL of water is then added to the reaction vessel. A 2M solution of $AgNO_3$ and a 2M solution of NaCl are simultaneously run into the reaction vessel with rapid stirring, each at a flow rate of 249 mL/min with controlled pAg of 7.51. The double-jet precipitation is continued for 21.5 minutes, after which the emulsion is cooled to 38° C., washed to a pAg of 7.26, and then concentrated. Additional gelatin is introduced to achieve 43.4 grams of gelatin/Ag mole, and the emulsion is adjusted to pH of 5.7 and pAg of 7.50. The resulting silver chloride emulsion has a cubic grain morphology and a 0.34 μm average edge length. The dopant to be tested is dissolved in the NaCl solution or, if the dopant is not stable in that solution, the dopant is introduced from aqueous solution via a third jet.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20, 40 and 60° K, respectively, exposing each sample to the filtered output of a 200W Hg lamp at a wavelength of 365 nm (preferably 400 nm for AgBr or AgIBr emulsions), and measuring the EPR electron signal during exposure. if, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are useful coordination complexes for forming shallow electron trapping sites. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588.

In a specific form it is contemplated to employ as a SET dopant a hexacoordination complex satisfying the formula:

$$[ML_6]^n \quad (I)$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least of the ligands is more electronegative than any halide ligand; and n is −1, −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |
| SET-28 | $[Pt(CN)_4(H_2O)_2]^{-1}$ |

Instead of employing hexacoordination complexes containing $Ir^{+3}$, it is preferred to employ $Ir^{+4}$ coordination complexes. These can, for example, be identical to any one of the iridium complexes listed above, except that the net valence is −2 instead of −3. Analysis has revealed that $Ir^{+4}$ complexes introduced during grain precipitation are actually incorporated as $Ir^{+3}$ complexes. Analyses of iridium doped grains have never revealed $Ir^{+4}$ as an incorporated ion. The advantage of employing $Ir^{+4}$ complexes is that they are more stable under the holding conditions encountered prior to emulsion precipitation. This is discussed by Leubner et al U.S. Pat. No. 4,902,611, here incorporated by reference.

The SET dopants are effective at any location within the grains. Generally better results are obtained when the SET dopant is incorporated in the exterior 50 percent of the grain, based on silver. To insure that the dopant is in fact incorporated in the grain structure and not merely associated with the surface of the grain, it is preferred to introduce the SET dopant prior to forming the maximum iodide concentration region of the grain. Thus, an optimum grain region for SET incorporation is that formed by silver ranging from 50 to 85 percent of total silver forming the grains. That is, SET introduction is optimally commenced after 50 percent of total silver has been introduced and optimally completed by the time 85 percent of total silver has precipitated. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

The exposure (E) of a photographic element is the product of the intensity (I) of exposure multiplied by its duration (t):

$$E=I\times t \quad \text{(II)}$$

According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure.

When exposure times are reduced below one second to very short intervals (e.g., $10^{-5}$ second or less), higher exposure intensities must be employed to compensate for the reduced exposure times. High intensity reciprocity failure (hereinafter also referred to as HIRF) occurs when photographic performance is noted to depart from the reciprocity law when varied exposure times of less than 1 second are employed.

SET dopants are also known to be effective to reduce HIRF. However, as demonstrated in the Examples below, it is an advantage of the invention that the emulsions of the invention show unexpectedly low levels of high intensity reciprocity failure even in the absence of dopants.

Iridium dopants that are ineffective to provide shallow electron traps—e.g., either bare iridium ions or iridium coordination complexes that fail to satisfy the more electropositive than halide ligand criterion of formula I above can be incorporated in the iodochloride grains of the invention to reduce reciprocity failure. These iridium dopants are effective to reduce both high intensity reciprocity failure (HIRF) and low intensity reciprocity failure (hereinafter also referred to as LIRF). Low intensity reciprocity failure is the term applied to observed departures from the reciprocity law of photographic elements exposed at varied times ranging from 1 second to 10 seconds, 100 seconds or longer time intervals with exposure intensity sufficiently reduced to maintain an unvaried level of exposure.

The reciprocity failure reducing Ir dopant can be introduced into the silver iodochloride grain structure as a bare metal ion or as a non-SET coordination complex, typically a hexahalocoordination complex. in either event, the iridium ion displaces a silver ion in the crystal lattice structure. When the metal ion is introduced as a hexacoordination complex, the ligands need not be limited to halide ligands. The ligands are selected as previously described in connection with formula I, except that the incorporation of ligands more electropositive than halide is restricted so that the coordination complex is not capable of acting as a shallow electron trapping site.

To be effective for reciprocity improvement the Ir must be incorporated within the silver iodochloride grain structure. To insure total incorporation it is preferred that Ir dopant introduction be complete by the time 99 percent of the total silver has been precipitate. For reciprocity improvement the Ir dopant can be present at any location within the grain structure. A preferred location within the grain structure for Ir dopants reciprocity improvement, is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, higher levels of incorporation can be tolerated, up about $1\times10^{-4}$ mole per silver, when reductions from the highest attainable levels of sensitivity can be tolerated. Specific illustrations of useful Ir dopants contemplated for reciprocity failure reduction are provided by B. H. Carroll, "Iridium Sensitization: A Literature Review", *Photographic Science and Engineering*, Vol. 24, No. 6 November/December 1980, pp. 265–267; iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of photographic elements containing silver iodochloride emulsions of the invention can be further increased by doping the silver iodochloride grains with a hexacoordination complex containing a nitrosyl or thionitrosyl ligand. Preferred coordination complexes of this type are represented by the formula:

$$[TE_4(NZ)E']^r \quad \text{(III)}$$

where

T is a transition metal;

E is a bridging ligand;

E' is E or NZ;

r is zero, −1, −2 or −3; and

Z is oxygen or sulfur.

The E ligands can take any of the forms found in the SET dopants and non-SET Ir dopants discussed above. A listing of suitable coordination complexes satisfying formula III is found in McDugle et al U.S. Pat. No. 4,933,272, the disclosure of which is here incorporated by reference.

The contrast increasing dopants (hereinafter also referred to as NZ dopants) can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

After precipitation and before chemical sensitization the emulsions can be washed by any convenient conventional technique. Conventional washing techniques are disclosed by *Research Disclosure*, Item 36544, cited above, Section III. Emulsion washing.

The emulsions can prepared in any mean grain size known to be useful in photographic print elements. Mean grain sizes in the range of from 0.15 to 2.5 μm are typical, with mean grain sizes in the range of from 0.2 to 2.0 μm being generally preferred.

The silver iodochloride emulsions can be chemically sensitized with active gelatin as illustrated by T. H. James, *The Theory of the Phogographic Process*, 4th Ed., Macmillan, 1977, pp. 67–76, or with middle chalcogen (sulfur, selenium or tellurium), gold, a platinum metal (platinum, palladium, rhodium, ruthenium, iridium and osmium), rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Smith et al U.S. Pat. No. 2,448,060, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696, chemical sensitization being optionally conducted in the presence of thiocyanate derivatives as described in Damschroder U.S. Pat. No. 2,642,361, thioether compounds as disclosed in Lowe et al U.S. Pat. No. 2,521,926, Williams et al U.S. Pat. No. 3,021,215 and Bigelow U.S. Pat. No. 4,054,457, and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714, Kajiwara et al U.S. Pat. No. 4,897,342, Yamada et al U.S. Pat. No. 4,968,595, Yamada U.S. Pat. No. 5,114,838, Yamada et al U.S. Pat. No. 5,118,600, Jones et al U.S. Pat. No. 5,176,991, Toya et al U.S. Pat. No. 5,190,855 and EPO 0 554 856, elemental sulfur as described by Miyoshi et al EPO 0 294,149 and Tanaka et al EPO 0 297,804, and thiosulfonates as described by Nishikawa et al EPO 0 293,917. Additionally or alternatively, the emulsions can be reduction-sensitized—e.g., by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Yamashita et al U.S. Pat. No. 5,254,456, EPO 0 407 576 and EPO 0 552 650.

Further illustrative of sulfur sensitization are Mifune et al U.S. Pat. No. 4,276,374, Yamashita et al U.S. Pat. No. 4,746,603, Herz et al U.S. Pat. Nos. 4,749,646 and 4,810,626 and the lower alkyl homologues of these thioureas, Ogawa U.S. Pat. No. 4,786,588, Ono et al U.S. Pat. No. 4,847,187, Okumura et al U.S. Pat. No. 4,863,844, Shibahara U.S. Pat. No. 4,923,793, Chino et al U.S. Pat. No. 4,962,016, Kashi U.S. Pat. No. 5,002,866, Yagi et al U.S. Pat. No. 5,004,680, Kajiwara et al U.S. Pat. No. 5,116,723, Lushington et al U.S. Pat. No. 5,168,035, Takiguchi et al U.S. Pat. No. 5,198,331, Patzold et al U.S. Pat. No. 5,229,264, Mifune et al U.S. Pat. No. 5,244,782, East German DD 281 264 A5, German DE 4,118,542 A1, EPO 0 302 251, EPO 0 363 527, EPO 0 371 338, EPO 0 447 105 and EPO 0 495 253. Further illustrative of iridium sensitization are Ihama et al U.S. Pat. No. 4,693,965, Yamashita et al U.S. Pat. No. 4,746,603, Kajiwara et al U.S. Pat. No. 4,897,342, Leubner et al U.S. Pat. No. 4,902,611, Kim U.S. Pat. No. 4,997,751, Johnson et al U.S. Pat. No. 5,164,292, Sasaki et al U.S. Pat. No. 5,238,807 and EPO 0 513 748 A1. Further illustrative of tellurium sensitization are Sasaki et al U.S. Pat. No. 4,923,794, Mifune et al U.S. Pat. No. 5,004,679, Kojima et al U.S. Pat. No. 5,215,880, EPO 0 541 104 and EPO 0 567 151. Further illustrative of selenium sensitization are Kojima et al U.S. Pat. No. 5,028,522, Brugger et al U.S. Pat. No. 5,141,845, Sasaki et al U.S. Pat. No. 5,158,892, Yagihara et al U.S. Pat. No. 5,236,821, Lewis U.S. Pat. No. 5,240,827, EPO 0 428 041, EPO 0 443 453, EPO 0 454 149, EPO 0 458 278, EPO 0 506 009, EPO 0 512 496 and EPO 0 563 708. Further illustrative of rhodium sensitization are Grzeskowiak U.S. Pat. No. 4,847,191 and EPO 0 514 675. Further illustrative of palladium sensitization are Ihama U.S. Pat. No. 5,112,733, Sziics et al U.S. Pat. No. 5,169,751, East German DD 298 321 and EPO 0 368 304. Further illustrative of gold sensitizers are Mucke et al U.S. Pat. No. 4,906,558, Miyoshi et al U.S. Pat. No. 4,914,016, Mifune U.S. Pat. No. 4,914,017, Aida et al U.S. Pat. No. 4,962,015, Hasebe U.S. Pat. No. 5,001,042, Tanji et al U.S. Pat. No. 5,024,932, Deaton U.S. Pat. Nos. 5,049,484 and 5,049,485, Ikenoue et al U.S. Pat. No. 5,096,804, EPO 0 439 069, EPO 0 446 899, EPO 0 454 069 and EPO 0 564 910. The use of chelating agents during finishing is illustrated by Klaus et al U.S. Pat. No. 5,219,721, Mifune et al U.S. Pat. No. 5,221,604, EPO 0 521 612 and EPO 0 541 104.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,693,965, Ogawa U.S. Pat. No. 4,791,053 and Daubendiek et al U.S. Pat. No. 4,639,411, Metoki et al U.S. Pat. No. 4,925,783, Reuss et al U.S. Pat. No. 5,077,183, Morimoto et al U.S. Pat. No. 5,130,212, Fickie et al U.S. Pat. No. 5,141,846, Kajiwara et al U.S. Pat. No. 5,192,652, Asami U.S. Pat. No. 5,230,995, Hashi U.S. Pat. No. 5,238,806, East German DD 298 696, EPO 0 354 798, EPO 0 509 519, EPO 0 533 033, EPO 0 556 413 and EPO 0 562 476. Chemical sensitization can be directed to specific sites or crystallographic faces on the silver halide grain as described by Haugh et al U.K. Patent 2,038,792, Maskasky U.S. Pat. No. 4,439,520 and Mifune et al EPO 0 302 528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan cited above, the chemical sensitizers can be added prior to or concurrently with the additional silver halide formation.

During finishing urea compounds can be added, as illustrated by Burgmaier et al U.S. Pat. No. 4,810,626 and Adin U.S. Pat. No. 5,210,002. The use of N-methyl formamide in finishing is illustrated in Reber EPO 0 423 982. The use of ascorbic acid and a nitrogen containing heterocycle are illustrated in Nishikawa EPO 0 378 841. The use of hydrogen peroxide in finishing is disclosed in Mifune et al U.S. Pat. No. 4,681,838.

Sensitization can be effected by controlling gelatin to silver ratio as in Vandenabeele EPO 0 528 476 or by heating prior to sensitizing as in Berndt East German DD 298 319.

The emulsions can be spectrally sensitized in any convenient conventional manner. Spectral sensitization and the selection of spectral sensitizing dyes is disclosed, for example, in *Research Disclosure*, Item 36544, cited above, Section V. Spectral sensitization and desensitization.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agentselend halogen acceptors or electron acceptors, as disclosed in Brooker et al U.S. Pat. No. 2,131,038, illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1

Anhydro-5'-chloro-3,3'-bis(3-sulfopropyl)naphtho[1,2-d]thiazolothiacyanine hydroxide, triethylammonium salt

SS-2

Anhydro-5'-chloro-3,3'-bis(3-sulfopropyl)naphtho[1,2-d]oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-bis(trifluoromethyl)-3-(4-sulfobutyl)-3'-(2,2,2-trifluoroethyl)benzimidazolocarbocyanine hydroxide

SS-6

Anhydro-3,3'-bis(2-methoxyethyl)-5,5'-diphenyl-9-ethyloxacarbocyanine, sodium salt

SS-7

Anhydro-1,1'-bis(3-sulfopropyl)-11-ethylnaphtho[1,2-d]-oxazolocarbocyanine hydroxide, sodium salt

SS-8

Anhydro-5,5'-dichloro-9-ethyl-3,3'-bis(3-sulfopropyl)oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbodyanine hydroxide

SS-11

Anhydro-5,5'-dichloro-9-ethyl-3,3'-bis(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-bis(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

3-Ethyl-6,6'-dimethyl-3'-pentyl-9,11-neopentylenethiadicarbocyanine bromide

SS-19

Anhydro-3-ethyl-9,11-neopentylene-3'-(3-sulfopropyl) thiadicarbocyanine hydroxide

SS-20

Anhydro-3-ethyl-11,13-neopentylene-3'-(3-sulfopropyl) oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, triethylammonium salt

SS-22

Anhydro-5,5'-diphenyl-3,3'-bis(3-sulfobutyl)-9-ethyl-oxacarbocyanine hydroxide, sodium salt

SS-23

Anhydro-5,5'-dichloro-3,3'-bis(3-sulfopropyl)-9-ethylthiacarbocyanine hydroxide, triethylammonium salt

SS-24

Anhydro-5,5'-dimethyl-3,3'-bis(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d] thiazolocarbocyanine hydroxide, triethylammonium salt

SS-26

Anhydro-1,1'-bis(3-sulfopropyl)-11-ethylnaphth[1,2-d]-oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-bis(3-sulfopropyl)-5,5'-bis(trifluoromethyl)benzimidazolocarbocyanine hydroxide, sodium salt

SS-29

Anhydro-5'-chloro-5-phenyl-3,3'-bis(3-sulfopropyl) oxathiacyanine hydroxide, triethylammonium salt

SS-30

Anhydro-5,5'-dichloro-3,3'-bis(3-sulfopropyl)thiacyanine hydroxide, sodium salt

SS-31

3-Ethyl-5-[1,4-dihydro-1-(4-sulfobutyl)pyridin-4-ylidene] rhodanine, triethylammonium salt

SS-32

1-Carboxyethyl-5-[2-(3-ethylbenzoxazolin-2-ylidene) ethylidene]-3-phenylthiohydantoin

SS-33

4-[2-(1,4-Dihydro-1-dodecylpyridinylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-{2-{3-(2-methoxyethyl)-5-[(2-methoxyethyl)sulfonamido] benzoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d] thiazolin]-2-butenylidene}-2-thiohydantoin

SS-41

1,4-Phenylene-bis(2-aminovinyl-3-methyl-2-thiazolinium) dichloride

SS-42

Anhydro-4-{2-[3-(3-sulfopropyl)thiazolin-2-ylidene] ethylidene}-2-{3-[3-(3-sulfopropyl)thiazolin-2-ylidene] propenyl-5-oxazolium, hydroxide, sodium salt

SS-43

3-Carboxymethyl-5-{3-carboxymethyl-4-oxo-5-methyl-1,3,4-thiadiazolin-2-ylidene)ethylidene]thiazolin-2-ylidene}rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)-methyl]-[(1,5-dimethylnaphtho[1,2-d]selenazolin-2-ylidene)methyl]methylene}rhodanine

SS-48

5-{Bis[(3-ethyl-5,6-dimethylbenzothiazolin-2-ylidene)methyl]methylene}-1,3-diethylbarbituric acid

SS-49

3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-bis(3-sulfopropyl)thiacyanine hydroxide, triethylammonium salt

SS-51

Anhydro-5-chloro-5'-phenyl-3,3'-bis(3-sulfopropyl)thiacyanine hydroxide, triethylammonium salt

SS-52

Anhydro-5-chloro-5'-pyrrolo-3,3'-bis(3-sulfopropyl)thiacyanine hydroxide, triethylammonium salt Preferred supersensitizing compounds for use with the spectral sensitizing dyes are 4,4'-bis(1,3,5-triazinylamino)stilbene-2,2'-bis(sulfonates).

The silver iodochloride emulsions are preferably protected against changes in fog upon aging. Preferred antifoggants can be selected from among the following groups:

A. A mercapto heterocyclic nitrogen compound containing a mercapto group bonded to a carbon atom which is linked to an adjacent nitrogen atom in a heterocyclic ring system, B. A quaternary aromatic chalcogenazolium salt wherein the chalcogen is sulfur, selenium or tellurium, C. A triazole or tetrazole containing an ionizable hydrogen bonded to a nitrogen atom in a heterocyclic ring system, or D. A dichalcogenide compound comprising an —X—X- linkage between carbon atoms wherein each X is divalent sulfur, selenium or tellurium.

The Group A photographic antifoggants employed in the practice of this invention are mercapto heterocyclic nitrogen compounds containing a mercapto group bonded to a carbon atom which is linked to an adjacent nitrogen atom in a heterocyclic ring system. Typical Group A antifoggants are heterocyclic mercaptans such as mercaptotetrazoles, for example a 5-mercaptotetrazole, and more particularly, an aryl 5-mercaptotetrazole such as a phenyl 5-mercaptotetrazole. Suitable Group A antifoggants that can be employed are described in the following documents, the disclosures of the U.S. patents which are hereby incorporated herein by reference: mercaptotetrazoles, -triazoles and -diazoles as illustrated by Kendall U.S. Pat. No. 2,403,927, Kennard et al U.S. Pat. No. 3,266,897, *Research Disclosure*, Vol. 116, December 1973, Item 11684, Luckey et al U.S. Pat. No. 3,397,987, Salesin U.S. Pat. No. 3,708,303 and purines as illustrated by Sheppard et al U.S. Pat. No. 2,319,090.

The heterocyclic ring system of the Group A antifoggants can contain one or more heterocyclic rings wherein the heterocyclic atoms (i.e., atoms other than carbon, including nitrogen, oxygen, sulfur, selenium and tellurium) are members of at least one heterocyclic ring. A heterocyclic ring in a ring system can be fused or condensed to one or more rings that do not contain heterocyclic atoms. Suitable heterocyclic ring systems include the monoazoles (e.g., oxazoles, benzoxazoles, selenazoles, benzothiazoles), diazoles (e.g., imidazoles, benzimidazoles, oxadiazoles and thiadiazoles), triazoles (e.g., 1,2,4-triazoles, especially those containing an amino substituent in addition to the mercapto group), pyrimidines, 1,2,4-triazines, s-triazines, and azaindenes (e.g., tetraazaindenes). It is understood that the term mercapto includes the undissociated thioenol or tautomeric thiocarbonyl forms, as well as the ionized, or salt forms. When the mercapto group is in a salt form, it is associated with a cation of an alkali metal such as sodium or potassium, or ammonium, or a cationic derivative of such amines as triethylamine, triethanolamine, or morpholine.

Any of the mercapto heterocyclic nitrogen compounds, as described herein, will act as antifoggants in the practice of this invention. However, particularly good results are obtained with the mercaptoazoles, especially the 5-mercaptotetrazoles. 5-Mercaptotetrazoles which can be employed include those having the structure:

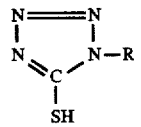

(A-I)

where R is a hydrocarbon (aliphatmc or aromatic) radical containing up to 20 carbon atoms. The hydrocarbon radicals comprising R can be substituted or unsubstituted. Suitable substituents include, for example, alkoxy, phenoxy, halogen, cyano, nitro, amino, amido, carbamoyl, sulfamoyl, sulfonamido, sulfo, sulfonyl, carboxy, carboxylate, ureido and carbonyl phenyl groups. instead of an —SH group as shown in formula A-I, an —SM group can be substituted, where M represents a monovalent metal cation.

Some thiadiazole or oxadiazole Group A antifoggants that can be employed in the practice of this invention can be represented by the following structure:

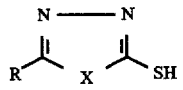

(A-II)

where X is S or O, and R is as defined in Formula (A-I) hereinbefore.

Some benzochalcogenazole Group A antifoggants that can be employed in the practice of this invention can be represented by the following structure:

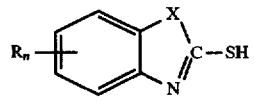

(A-III)

where X is O, S or Se, R is alkyl containing up to four carbon atoms, such as methyl, ethyl, propyl, butyl; alkoxy containing up to four carbon atoms, such as methoxy, ethoxy, butoxy; halogen, such as chloride or bromide, cyano, amido, sulfamido or carboxy, and n is 0 to 4.

Examples of Group A photographic antifoggants useful in the practice of this invention are 1-(3-acetamidophenyl)-5-mercaptotetrazole, 1-(3-benzamido-phenyl)-5-mercaptotetrazole, 5-mercapto-1-phenyl-tetrazole, 5-mercapto-1-(3-methoxyphenyl)tetrazole, 5-mercapto-1-(3-sulfophenyl)tetrazole, 5-mercapto-1-(3-ureidophenyl) tetrazole, 1-(3-N-carboxymethyl)-ureidophenyl)-5-mercaptotetrazole, 1-(3-N-ethyl oxalylamido)phenyl)-5-mercaptotetrazole, 5-mercapto-1-(4-ureidophenyl)tetrazole, 1-(4-acetamidophenyl)-5-mercaptotetrazole, 5-mercapto-1-(4-methoxyphenyl)tetrazole, 1-(4-carboxyphenyl)-5-mercaptotetrazole, 1-(4-chlorophenyl)-5-mercaptotetrazole, 2-mercapto-5-phenyl-1,3,4-oxadiazote, 5-(4-acetamidophenyl)-2-mercapto-1,3,4-oxadiazole, 2-mercapto-5-phenyl-1,3,4-thiadiazole, 2-mercapto-5-(4-ureidophenyl)-1,3,4-thiadiazole, 2-mercaptobenzoxazole, 2-mercaptobenzothiazole, 2-mercaptobenzoselenazole, 2-mercapto-5-methylbenzoxazole, 2-mercapto-5-methoxybenzoxazole, 6-chloro-2-mercaptobenzothiazole and 2-mercapto-6-methylbenzothiazole.

The Group B photographic antifoggants are quaternary aromatic chalcogenazolium salts wherein the chalcogen is sulfur, selenium or tellurium. Typical Group B antifoggants are azolium salts such as benzothiazolium salts, benzoselenazolium salts and benzotellurazolium salts. Charge balancing counter ions for such salts include a wide variety of negatively charged ions, as well known in the photographic art, and exemplified by chloride, bromide, iodide, perchlorate, benzenesulfonate, propylsulfonaee, toluenesulfonate, tetrafluoroborate, hexafluorophosphate and methyl sulfate. Suitable Group B antifoggants that can be employed are described in the following U.S. patents, the disclosures of which are hereby incorporated herein by reference: quaternary ammonium salts of the type illustrated by Allen et al U.S. Pat. No. 2,694,716, Brooker et al U.S. Pat. No. 2,131,038, Graham U.S. Pat. No. 3,342,596, Arai et al U.S. Pat. No. 3,954,478 and Przyklek-Elling U.S. Pat. No. 4,661,438.

Some Group B antifoggants that may be employed in the practice of this invention can be represented by the following structure:

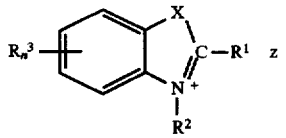

(B)

where

X is S, Se or Te;

$R^1$ is hydrogen when X is S, and is methyl when X is Se or Te;

$R^2$ is substituted or unsubstituted alkyl or alkenyl containing up to six carbon atoms, such as methyl, ethyl, propyl, allyl, sulfopropyl or sulfamoylmethyl;

$R^3$ is alkyl containing up to four carbon atoms (such as methyl, propyl or butyl), alkoxy containing up to four carbon atoms (such as ethoxy or propoxy), halogen, cyano, amido, sulfamido or carboxy; and Z is an optional counter ion, such as halogen, benzenesulfonate or tetrafluoroborate, which is present when required to impart charge neutrality.

In a variant form, compounds satisfying formula B can be bis(benzochalcogenazolium) compounds linked through a common $R^2$ alkylene or alkendiyl group containing up to 12 carbon atoms.

Examples of useful Group B photographic antifoggants include 2-methyl-3-ethylbenzoselenazolium p-toluenesulfonate, 3-[2-(N-methylsulfonyl) carbamoylethyl]benzothiazolium tetrafluoroborate, 3,3'-decamethylene-bis-(benzothiazolium) bromide, 3-methylbenzothiazolium hydrogen sulfate, 3-allylbenzothiazolium tetrafluoroborate, 5,6-dimethoxy-3-sulfopropylbenzothiazollum salt, 5-chloro-3-methylbenzothiazolium tetrafluoroborate, 5,6-dichloro-3-ethylbenzothiazolium tetrafluoroborate, 5-methyl-3-allylbenzothiazolium tetrafluoroborate, 2-methyl-3-ethylbenzotellurazolium tetrafluoroborate, 2-methyl-3-allylbenzotellurazolium tetrafluoroborate, 2-methyl-3-allyl-5-chlorobenzoselenazolium tetrafluoroborate, 2-methyl-3-allyl-5-chlorobenzoselenazolium tetrafluoroborate and 2-methyl-3-allyl-5,6-dimethoxybenzoselenazolium p-toluenesulfonate.

The Group C photographic antifoggants are triazoles or tetrazoles which contain an ionizable (or dissociable) hydrogen bonded to a nitrogen atom in a heterocyclic ring system. Such a hydrogen atom is ionizable under normal conditions of preparation, storing or processing of the high chloride {100} tabular grain emulsions of this invention. The triazole or tetrazole ring can be fused to one or more aromatic, including heteroaromatic, rings containing 5 to 7 ring atoms to provide a heterocyclic ring system. Such heterocyclic ring systems include, for example, benzotriazoles, naphthotriazoles, tetraazaindenes and triazolotetrazoles. The triazole or tetrazole rings can contain substituents including lower alkyl such as methyl, ethyl, propyl, aryl containing up to 10 carbon atoms, for example, phenyl or naphthyl. Suitable additional substituents in the heterocyclic ring system include hydromy, halogen such as chlorine, bromine, iodine; cyano, alkyl such as methyl, ethyl, propyl, trifluoromethyl; aryl such as phenyl, cyanophenyl, naphthyl, pyridyl; aralkyl such as benzyl, phenethyl; alkoxy such as methoxy, ethoxy; aryloxy such as phenoxy; alkylthio such as methylthio, carboxymethylthio; acyl such as formyl, formamidino, acetyl, benzoyl, benzenesulfonyl; carboalkoxy such as carboethoxy, carbomethoxy or carboxy.

Typical Group C antifoggants are tetrazoles, benzotriazoles and tetraazaindenes. Suitable Group C antifoggants that can be employed are described in the following documents, the disclosures of the U.S. patents which are hereby incorporated herein by reference: tetrazoles, as illustrated by P. Glafkides "Photographic Chemistry", Vol. 1, pages 375–376, Fountain Press, London, published 1958, azaindenes, particularly tetraazaindenes, as illustrated by Heimbach et al U.S. Pat. No. 2,444,605, Knott U.S. Pat. No. 2,933,388, Williams et al. U.S. Pat. No. 3,202,512, *Research Disclosure*, Vol. 134, June 1975, item 13452 and Vol. 148, August 1976, Item 14851, Nepker et al U.K. Patent 1,338,567, Birr et al U.S. Pat. No. 2,152,460 and Dostes et al French Patent 2,296,204.

Some useful Group C antifoggants that can be employed in the practice of this invention can be represented by the following structures:

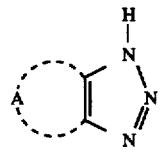

(C-I)

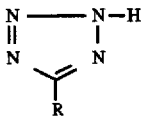

(C-II)

-continued

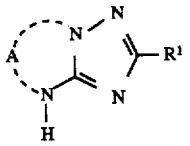

(C-III)

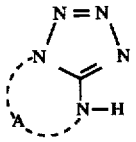

(C-IV)

where R is lower alkyl such as methyl, ethyl, propyl, butyl; or aryl containing up to 10 carbon atoms such as cyanophenyl or naphthyl; $R^1$, in addition to being the same as R, can also be hydrogen; alkoxy containing up to 8 carbon atoms, such as methoxy, ethoxy, butoxy, octyloxy; alkylthio containing up to 8 carbon atoms, such as methylthio, propylthio, pentylthio, octylthio; or aryloxy or arylthio containing up to 10 carbon atoms; and A represents the non-metallic atoms necessary to complete a 5- to 7-membered aromatic ring which can be substituted with, for example, hydroxy, halogen such as chlorine, bromine, iodine; cyano, alkyl such as methyl, ethyl, propyl, trifluoromethyl; aryl such as phenyl, cyanophenyl, naphthyl, pyridyl; aralkyl such as benzyl, phenethyl; alkoxy such as methoxy, ethoxy; aryloxy such as phenoxy; alkylthio such as methylthio, carboxymethylthio; acyl such as formyl, acetyl, benzoyl; alkylsulfonyl or arylsulfonyl, such as methanesulfonyl or benzenesulfonyl; carboalkoxy such as carboethoxy, carbomethoxy; or carboxy.

Typical useful Group C photographic antifoggants include 5-chlorobenzotriazole, 5,6-dichlorobenzotriazole, 5-cyanobenzotriazole, 5-trifluoromethylbenzotriazole, 5,6-diacetylbenzo-triazole, 5-(p-cyanophenyl)tetrazole, 5-(p-trifluoromethylphenyl)tetrazole, 5-(1-naphthyl)tetrazole, 5-(2-pyridyl)tetrazole, 4-hydroxy-6-methyl-1,3,3a,7-tetraazaindene sodium salt, 5-bromo-4-hydroxy-6-methyl-1,3,3a,7-tetraazaindene sodium salt, 4-hydroxy-6-methyl-2-methylthio-1,3,3a,7-tetraazaindene sodium salt, 5-bromo-4-hydroxy-6-methyl-2-octylthio-1,3,3a,7-tetraazaindene sodium salt and 4-hydroxy-6-methyl-1,2,3,3a,7-pentaazaindene sodium salt.

The Group D photographic antifoggants are dichalcogenide compounds comprising an —X—X- linkage between carbon atoms wherein each X is divalent sulfur, selenium or tellurium. Typical Group D antifoggants are organic disulfides, diselenides and ditellurides where the chalcogen joins aliphatic or aromatic groups or are part of a ring system. Suitable Group D antifoggants that can be employed are described in the following documents, the disclosures of the U.S. patents which are hereby incorporated herein by reference: diselenides as illustrated by Brown et al U.K. Patent 1,336,570, Poller et al U.K. Patent 1,282,303, aromatic tellurochalcogenides, as illustrated by Gunther et al U.S. Pat. No. 4,607,000 and Lok et al U.S. Pat. No. 4,607,001, cyclic oxaspiro ditellurides, as illustrated by Lok et al U.S. Pat. No. 4,861,703, 1,2-dithiolane-3-pentanoic acid (a.k.a., 5-thioctic acid), as illustrated by U.S. Pat. No. 2,948,614, and acylamidophenyl disulfides, as illustrated by U.S. Pat. No. 3,397,986. Some useful Group D photographic antifoggants that can be employed in the practice of this invention can be represented by the following structure:

$$R—X—X—R^1 \quad (D)$$

where X is divalent S, Se or Te, R and $R^1$ can be the same or different alkyl, typically containing one to four carbon atoms such as methyl, ethyl, propyl, butyl; aryl typically containing up to ten carbon atoms such as phenyl or naphthyl, and R and $R^1$ together can form a 5 to 7-membered ring containing only carbon atoms in combination with the S, Se or Te atoms. Such ring can be further substituted with halogen such a chlorine, acetamido, carboxyalkyl such as carboxybutyl and alkoxy, typically containing one to four carbon atoms such as methoxy, propoxy and butoxy. Examples of useful Group D photographic antifoggants are bis(4-acetamido)phenyl disulfide, bis(4-glutaramido)phenyl disulfide, bis(4-oxalamido)phenyl disulfide, bis(4-succinamido)phenyl disulfide, 1,2-dithiane-3-butanoic acid, 1,2-dithiolane-3-pentanoic acid, a,a-dithiodipropionic acid, b,b-dithiodipropionic acid, 2-oxa-6,7-diselenaspiro[3,4]octane, 2-oxa-6,7-ditelluraspiro-[3,4]octane, bis[2-(N-methylacetamido)-4,5-dimethylphenyl]ditelluride, bis[2-(N-methylacetamido)-4-methoxyphenyl]ditelluride, bis(2-acetamido-4-methoxyphenyl)diselenide, m-carboxyphenyldiselenide and p-cyanophenyldiselenide.

The photographic antifoggants of Groups A–D can be used in combination within each group, or in combination between different groups. Enolic reducing compounds that can be used in combination with the photographic antifoggants in Group A are described in T. H. James, *The Theory of the Photographic Process*, 4th Edition, MacMillan Publishing Company, Inc., 1977, Chapter 11, Section E, developing agents of the type HO—(CH=CH)$_n$—OH, and on page 311, Section F, developing agents of the type HO—(CH=CH)$_n$—$NH_2$. Representative members of the Section E developing agents hydroquinone or catechol. Representative members of the Section F developing agents are aminophenols and the aminopyrazolones. Suitable reducing agents that can be used in combination with the photographic antifoggants in Group A are also described in EPO 0 476 521 and 0 482 599 and published East German Patent Application DD 293 207 A5. Specific examples of useful reducing compounds are piperidinohexose reductone, 4,5-dihydroxybenzene-1,3-disulfonic acid (catecholdisulfonic acid), disodium salt, 4-(hydroxymethyl)-4-methyl-1-phenyl-3-pyrazolidinone, and hydroquinone compounds. Typical hydroquinones or hydroquinone derivatives that can be used in the combination described can be represented by the following structure:

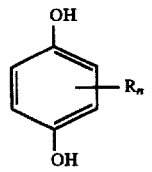

(E)

where R is the same or different and is alkyl such as methyl, ethyl, propyl, butyl, octyl; aryl such as phenyl, and contains up to 20 carbon atoms, typically 6–20 carbon atoms, or is —L—A where L is a divalent linking group such as oxygen, sulfur or amido, and A is a group which enhances adsorption onto silver halide grains such as a thionamido group, a mercapto group, a group containing a disulfide linkage or a 5- or 6-membered nitrogen-containing heterocyclic group and n is 0–2.

The photographic antifoggants used in the practice of this invention are conveniently incorporated into the silver iodochloride emulsions or elements comprising such emulsions just prior to coating the emulsion in the elements. However, they can be added to the emulsion at the time the emulsion is manufactured, for example, during chemical or spectral sensitization. It is generally most convenient to introduce such antifoggants after chemical ripening of the emulsion and before coating. The antifoggants can be added directly to the emulsion, or they can be added at a location within a photographic element which permits permeation to the emulsion to be protected. For example, the photographic antifoggants can be incorporated into hydrophilic colloid layers such as in an overcoat, interlayer or subbing layer just prior to coating. Any concentration of photographic antifoggant effective to protect the emulsion against changes in development fog and sensitivity can be employed. Optimum concentrations of photographic antifoggant for specific applications are usually determined empirically by varying concentrations in the manner well known to those skilled in the art. Such investigations are typically relied upon to identify effective concentrations for a specific situation. Of course, the effective concentration used will vary widely depending upon such things as the particular emulsion chosen, its intended use, storage conditions and the specific photographic antifoggant selected. Although an effective concentration for stabilizing the silver iodochloride emulsions may vary, concentrations of at least about 0.005 millimole per silver mole in the radiation sensitive silver halide emulsion have been found to be effective in specific situations. More typically, the minimum effective amount of photographic antifoggant is at least 0.03 millimole, and frequently at least 0.3 millimole per silver mole. For many of the photographic antifoggants used in this invention, the effective concentration is in the range of about 0.06 to 0.8 and often about 0.2 to 0.5 millimole/mole silver. However, concentrations well outside of these ranges can be used.

The emulsion coatings which contain photographic antifoggants of Groups A–D can be further protected against instability by incorporation of other antifoggants, stabilizers, antikinking agents, latent-image stabilizers and similar addenda in the emulsion and contiguous layers prior to coating. Further illustrations of the antifoggants in Groups A–D as well as the other antifoggants, stabilizers and similar addenda noted above are provided in *Research Disclosure*, Item 36544, cited above, Section VII. Antifoggants and stabilizers.

A single silver iodochloride emulsion satisfying the requirements of the invention can be coated on photographic support to form a photographic element. Any convenient conventional photographic support can be employed. Such supports are illustrated by *Research Disclosure*, item 36544, previously cited, Section XV. Supports.

In a specific, preferred form of the invention the silver iodochloride emulsions are employed in photographic elements intended to form viewable images—i.e., print materials. In such elements the supports are reflective (e.g., white). Reflective (typically paper) supports can be employed. Typical paper supports are partially acetylated or coated with baryta and/or a polyolefin, particularly a polymer of an a olefin containing 2 to 10 carbon atoms, such as polyethylene, polypropylene, copolymers of ethylene and propylene and the like. Polyolefins such as polyethylene, polypropylene and polyallomers—e.g., copolymers of ethylene with propylene, as illustrated by Hagemeyer et al U.S. Pat. No. 3,478,128, are preferably employed as resin coatings over paper as illustrated by Crawford et al U.S. Pat. No. 3,411,908 and Joseph et al U.S. Pat. No. 3,630,740, over polystyrene and polyester film supports as illustrated by Crawford et al U.S. Pat. No. 3,630,742, or can be employed as unitary flexible reflection supports as illustrated by Venor et al U.S. Pat. No. 3,973,963. More recent publications relating to resin coated photographic paper are illustrated by Kamiya et al U.S. Pat. No. 5,178,936, Ashida U.S. Pat. No. 5,100,770, Harada et al U.S. Pat. No. 5,084,344, Noda et al U.S. Pat. No. 5,075,206, Bowman et al U.S. Pat. No. 5,075,164, Dethlefs et al U.S. Pat. Nos. 4,898,773, 5,004,644 and 5,049,595, EPO 0 507 068 and EPO 0 290 852, Saverin et al U.S. Pat. No. 5,045,394 and German OLS 4,101,475, Uno et al U.S. Pat. No. 4,994,357, Shigetani et al U.S. Pat. Nos. 4,895,688 and 4,968,554, Tamagawa U.S. Pat. No. 4,927,495, Wysk et al U.S. Pat. No. 4,895,757, Kojima et al U.S. Pat. No. 5,104,722, Katsura et al U.S. Pat. No. 5,082,724, Nittel et al U.S. Pat. No. 4,906,560, Miyoshi et al EPO 0 507 489, Inahata et al EPO 0 413 332, Kadowaki et al EPO 0 546 713 and EPO 0 546 711, Skochdopole WO 93/04400, Edwards et al WO 92/17538, Reed et al WO 92/00418 and Tsubaki et al German OLS 4,220,737. Kiyohara et al U.S. Pat. No. 5,061,612, Shiba et al EPO 0 337 490 and EPO 0 389 266 and Noda et al German OLS 4,120,402 disclose pigments primarily for use in reflective supports. Reflective supports can include optical brighteners and fluorescent materials, as illustrated by Martic et al U.S. Pat. No. 5,198,330, Kubbota et al U.S. Pat. No. 5,106,989, Carroll et al U.S. Pat. No. 5,061,610 and Kadowaki et al EPO 0 484 871.

It is, of course, recognized that the photographic elements of the invention can include more than one emulsion. Where more than one emulsion is employed, such as in a photographic element containing a blended emulsion layer or separate emulsion layer units, all of the emulsions can be silver iodochloride emulsions as contemplated by this invention. Alternatively one more conventional emulsions can be employed in combination with the silver iodochloride emulsions of this invention. For example, a separate emulsion, such as a silver chloride or bromochloride emulsion, can be blended with a silver iodochloride emulsion according to the invention to satisfy specific imaging requirements. For example emulsions of differing speed are conventionally blended to attain specific aim photographic characteristics. instead of blending emulsions, the same effect can usually be obtained by coating the emulsions that might be blended in separate layers. It is well known in the art that increased photographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure*, Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure*, Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure*, Item 36544, Section VI. UV dyes/optical brighteners/luminescent dyes, paragraph (1). The overcoat, when present can usefully contain matting to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers, lubricants and matting agents are contained in *Research Disclosure*, item 36544, previously cited, Section IX. Coating physical property modifying addenda.

Preferably the photographic elements of the invention include a conventional processing solution decolorizable antihalation layer, either coated between the emulsion layer (s) and the support or on the back side of the support. Such layers are illustrated by *Research Disclosure*, Item 36544, cited above, Section VIII. Absorbing and Scattering Materials, Subsection B. Absorbing materials and Subsection C. Discharge.

A specific preferred application of the silver iodochloride emulsions of the invention is in color photographic elements, particularly color print (e.g., color paper) photographic elements intended to form multicolor images. In multicolor image forming photographic elements at least three superimposed emulsion layer units are coated on the support to separately record blue, green and red exposing radiation. The blue recording emulsion layer unit is typically constructed to provide a yellow dye image on processing, the green recording emulsion layer unit is typically constructed to provide a magenta dye image on processing, and the red recording emulsion layer unit is typically constructed to provide a cyan dye image on processing. Each emulsion layer unit can contain one, two, three or more separate emulsion layers sensitized to the same one of the blue, green and red regions of the spectrum. When more than one emulsion layer is present in the same emulsion layer unit, the emulsion layers typically differ in speed. Typically interlayers containing oxidized developing agent scavengers, such as ballasted hydroquinones or aminophenols, are interposed between the emulsion layer units to avoid color contamination. Ultraviolet absorbers are also commonly coated over the emulsion layer units or in the interlayers. Any convenient conventional sequence of emulsion layer units can be employed, with the following being the most typical:

| |
|---|
| Surface Overcoat |
| Ultraviolet Absorber |
| Red Recording Cyan Dye Image Forming Emulsion Layer Unit |
| Scavenger Interlayer |

-continued

| |
|---|
| Ultraviolet Absorber |
| Green Recording Magenta Dye Image Forming Emulsion Layer Unit |
| Scavenger Interlayer |
| Blue Recording Yellow Dye Image Forming Emulsion Layer Unit |
| Reflective Support |

Further illustrations of this and other layers and layer arrangements in multicolor photographic elements are provided in *Research Disclosure*, Item 36544, cited above, Section XI. Layers and layer arrangements.

Each emulsion layer unit of the multicolor photographic elements contain a dye image forming compound. The dye image can be formed by the selective destruction, formation or physical removal of dyes. Element constructions that form images by the physical removal of preformeddyes are illustrated by *Research Disclosure*, Vol. 308, December 1989, Item 308119, Section VII. Color materials, paragraph H. Element constructions that form images by the destruction of dyes or dye precursors are illustrated by *Research Disclosure*, item 36544, previously cited, Section X. Dye image formers and modifiers, Subsection A. Silver dye bleach. Dye-forming couplers are illustrated by *Research Disclosure*, Item 36544, previously cited, Section X. Subsection B. image-dye-forming couplers. It is also contemplated to incorporate in the emulsion layer units dye image modifiers, dye hue modifiers and image dye stabilizers, illustrated by *Research Disclosure*, item 36544, previously cited, Section X. Subsection C. Image dye modifiers and Subsection D. Hue modifiers/stabilization. The dyes, dye precursors, the above-noted related addenda and solvents (e.g., coupler solvents) can be incorporated in the emulsion layers as dispersions, as illustrated by *Research Disclosure*, Item 36544, previously cited, Section X. Subsection E. Dispersing and dyes and dye precursors. In the formation of dispersions.

The following are illustrative of specific preferred selections of dye-forming couplers and dye stabilizers, where the C, M and Y letters indicate cyan, magenta and yellow dye-forming couplers, respectively, and the letters ST indicate compounds that are dye image stabilizers.

C-1

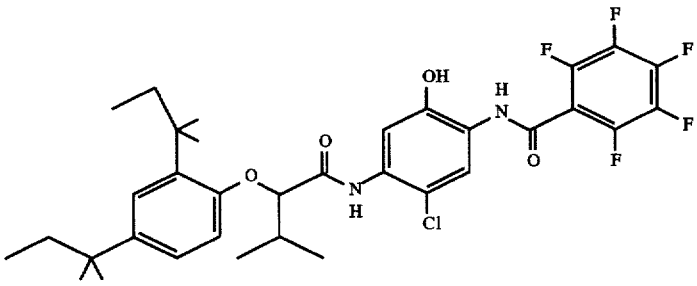

C-2

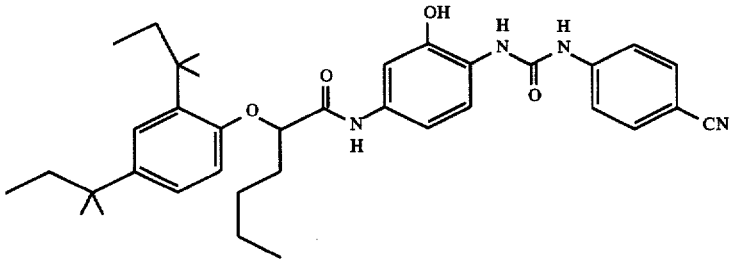

-continued
C-3
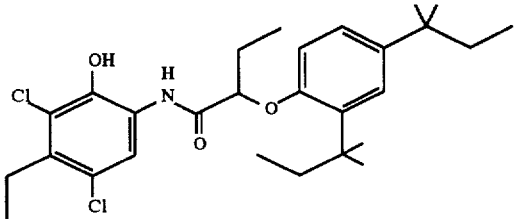
C-4
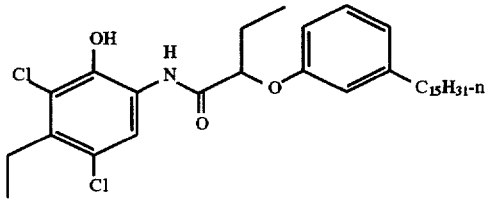
C-5
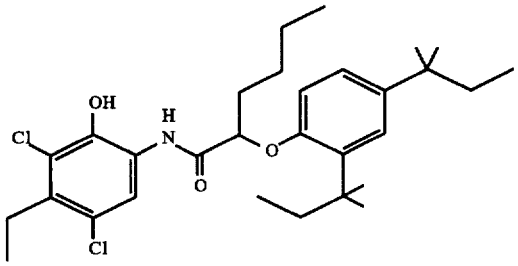
C-6
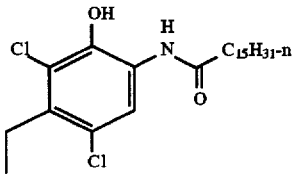
C-7
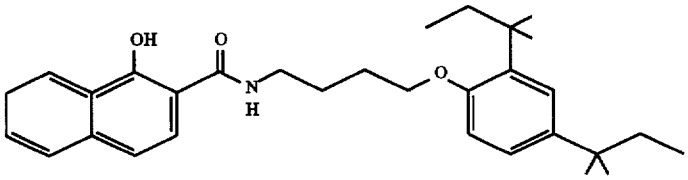
C-8
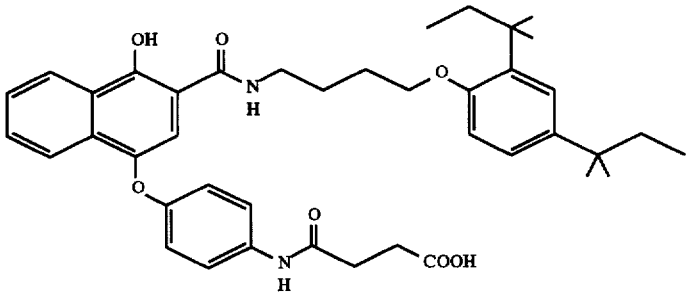
C-9
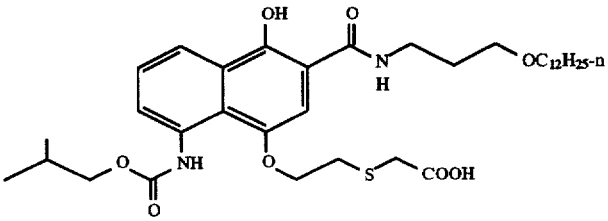
C-10
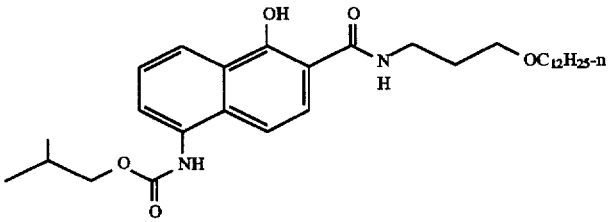

-continued
C-11
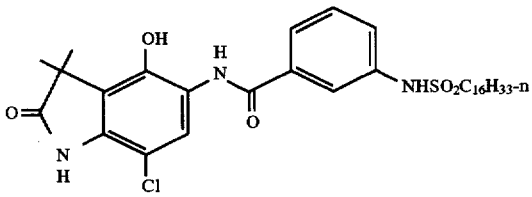
C-12
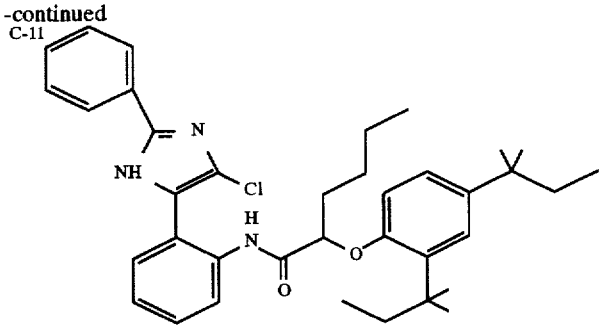
C-13
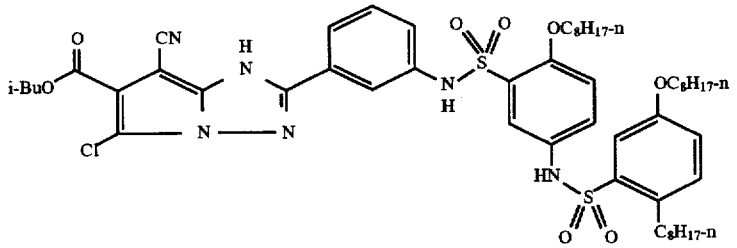
C-14
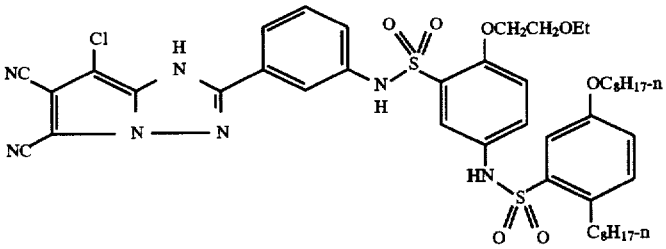
C-15
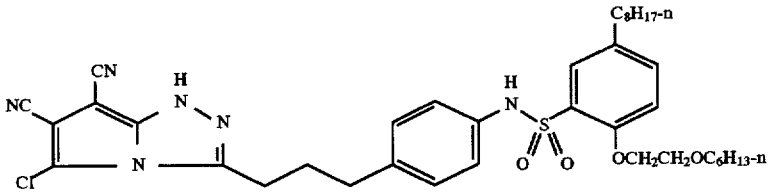
C-16
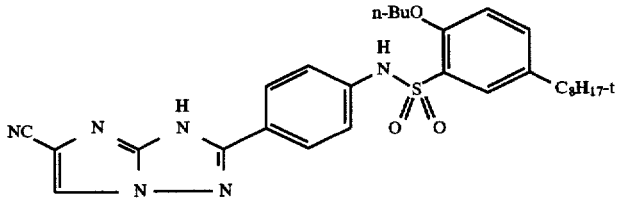
C-17
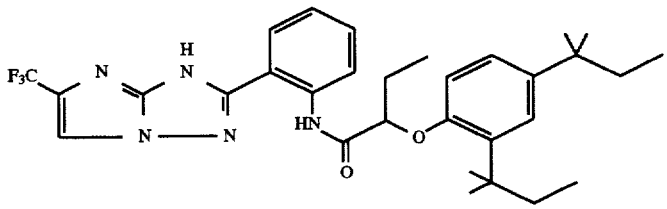
C-18
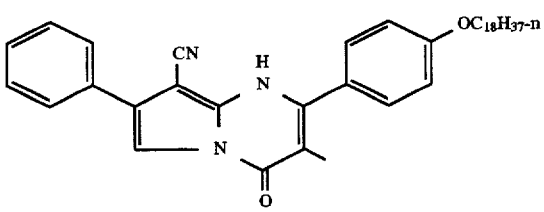
C-19
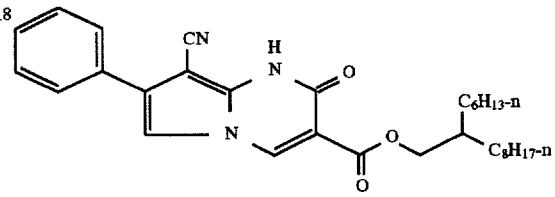

-continued
C-20
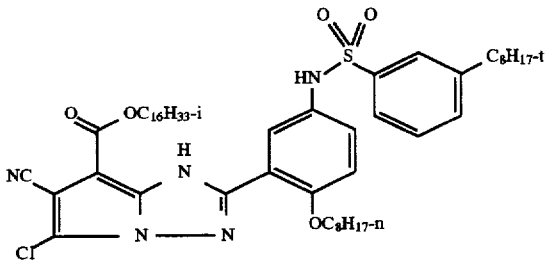
C-21
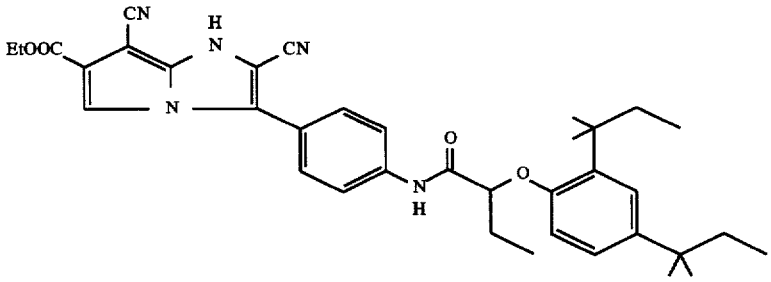
M-1
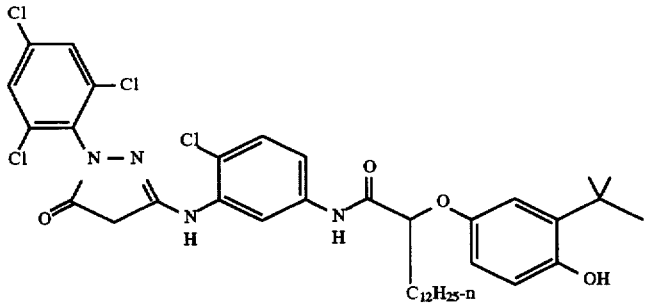
M-2
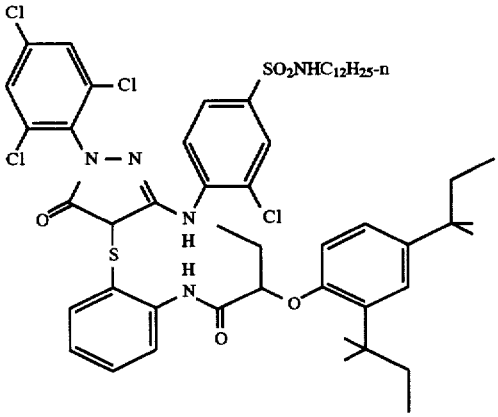
M-3
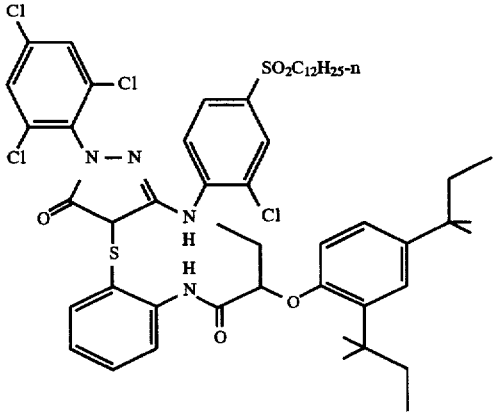

-continued
M-4
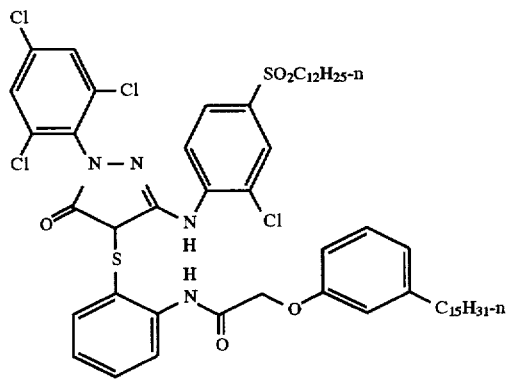
M-5
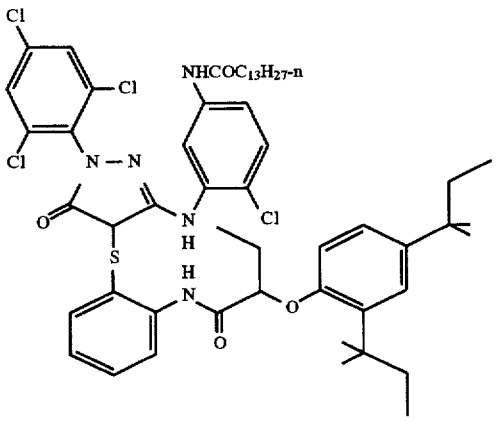
M-6
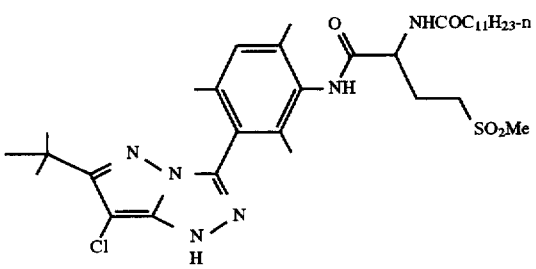
M-7
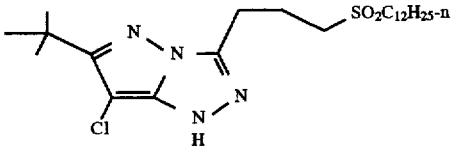
M-8
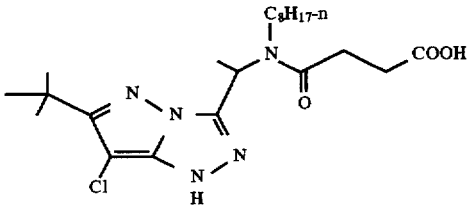
M-9
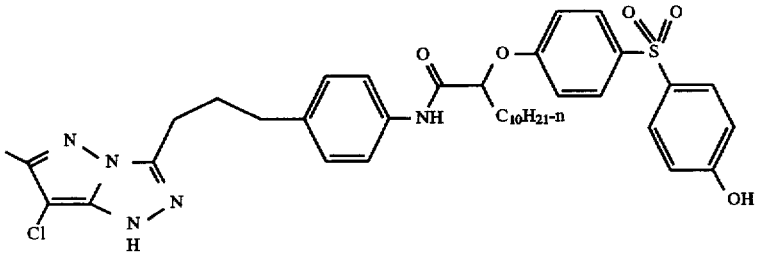
M-10
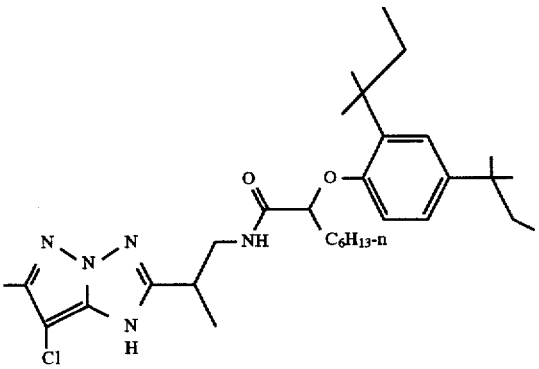

-continued
M-11
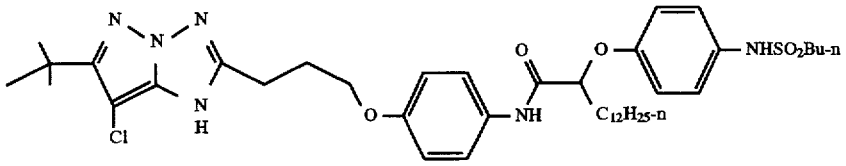
M-12
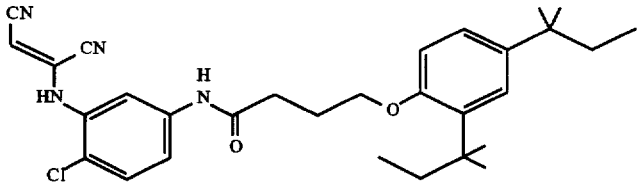
Y-1
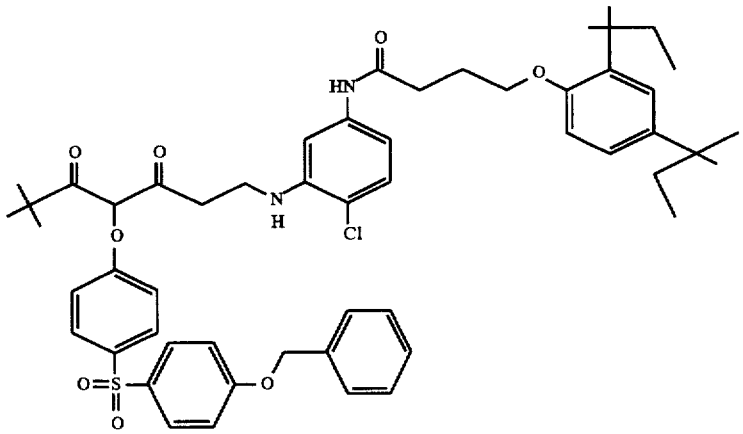
Y-2
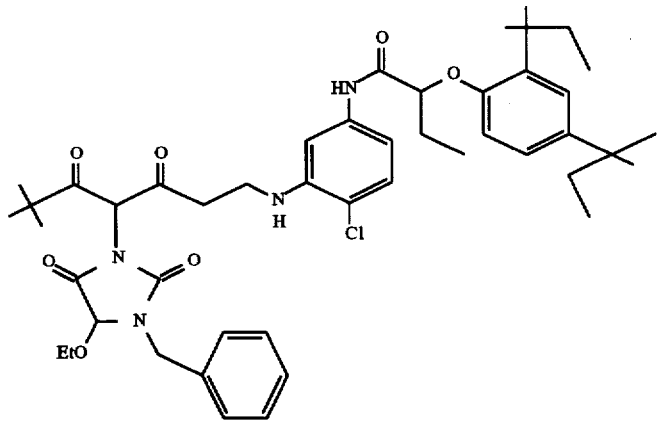
Y-3
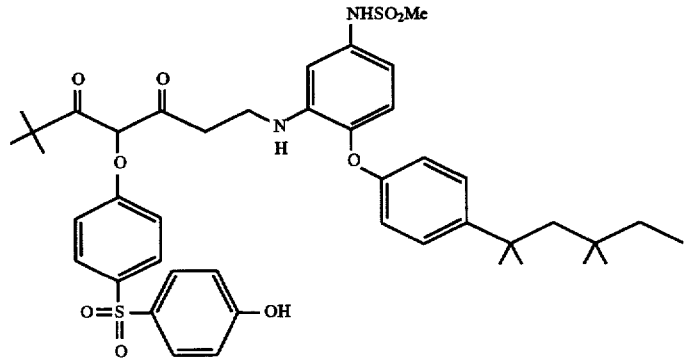

-continued
Y-4
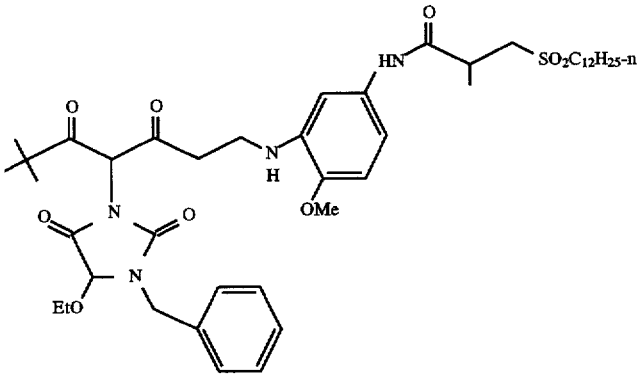
Y-5
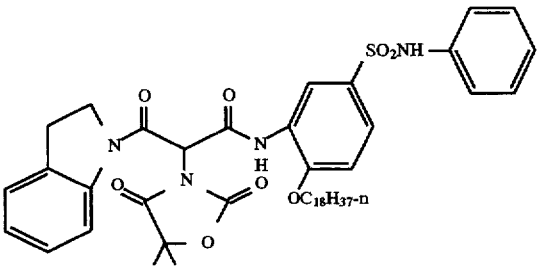
Y-6
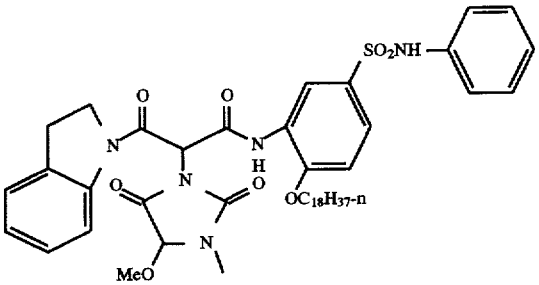
Y-7
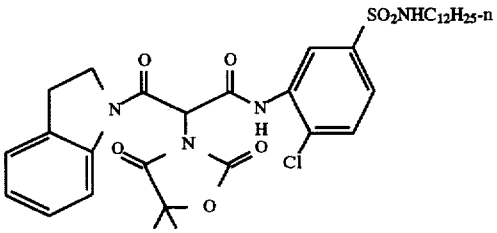
Y-8
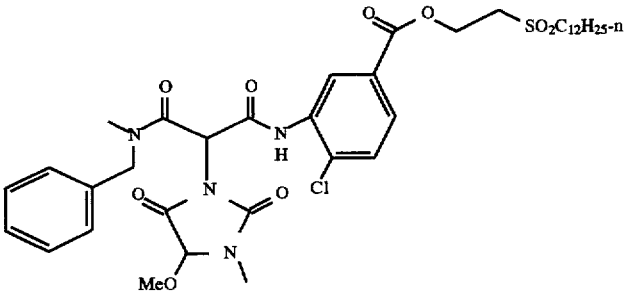
Y-9
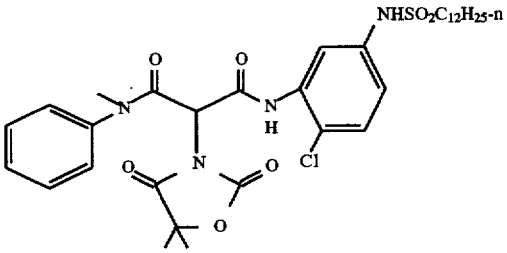

-continued
Y-10
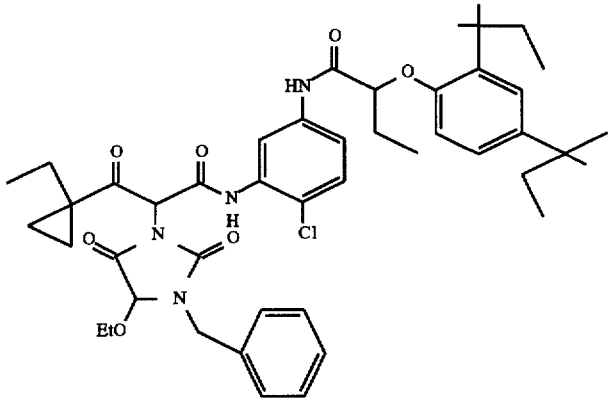
Solvents
| | |
|---|---|
| S-1 | Dibutyl phthalate |
| S-2 | Tritolyl phosphate |
| S-3 | N,N-Diethyldodecanamide |
| S-4 | Tris(2-ethylhexyl)phosphate |
| S-5 | 2-(2-Butoxyethoxy)ethyl acetate |
| S-6 | 2,5-Di-tert-pentylphenol |
| S-7 | Acetyl tributyl citrate |
Stabilizers
ST-1
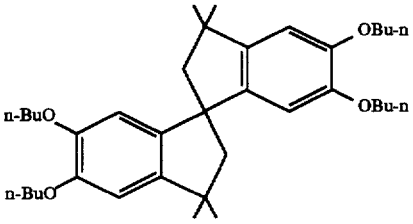
ST-2
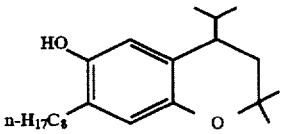
ST-3
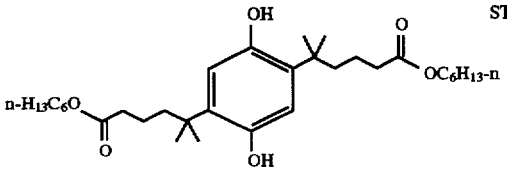
ST-4
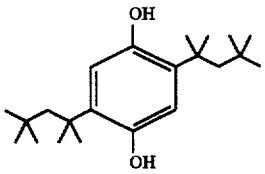
ST-5
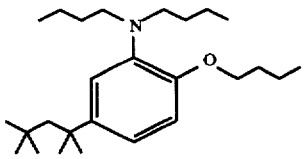
-continued
ST-6
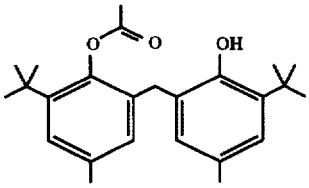
ST-7
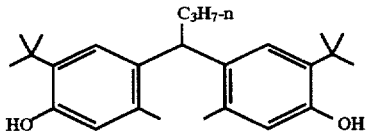
ST-8
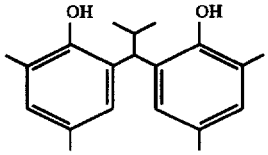
ST-9
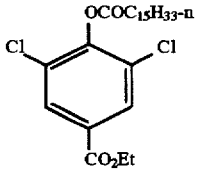
ST-10
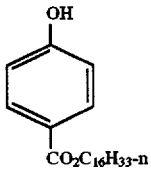
ST-11
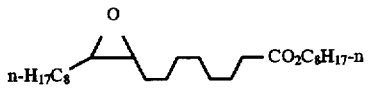
ST-12
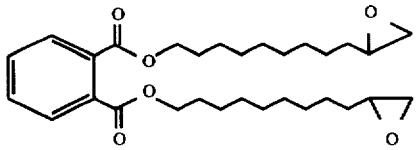

-continued

ST-13

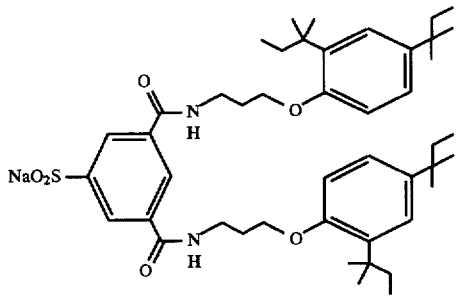

Still other conventional optional features can be incorporated in the photographic elements of the invention, such as those illustrated by *Research Disclosure*, Item 36544, previously cited, Section XIII. Features applicable only to color positive, subsection C. Color positives derived from color negatives and Section XVI. Scan facilitating features.

EXAMPLES

The invention can be better appreciated by reference to the following specific examples:

Example 1

This example compares silver chloride cubic grain emulsions with emulsions satisfying the requirements of the invention.

Emulsion A (control cubic grain AgCl emulsion)

A stirred tank reactor containing 7.2 Kg distilled water and 210 g of bone gelatin and 218 g 2M NaCl solution was adjusted to a pAg of 7.15 at 68.3° C. 1,8-Dihydroxy-3,6-dithiaoctane in the amount of 1.93 g was added to the reactor 30 seconds before the double jet addition of 4M $AgNO_3$ at 50.6 mL/min and 3.8M NaCl at a rate controlled to maintain a constant pAg of 7.15. After 5 minutes the silver jet addition was accelerated to 87.1 mL/min over a period of 6 minutes while the salt stream was again adjusted to maintain the pAg of 7.15. The silver jet addition rate remained at 87.1 mL/min for an additional 39.3 min while the pAg was held at 7.15. A total of 16.5 mole of AgCl was precipitated in the form of a monodisperse cubic grain emulsion having a mean grain size of 0.78 μm.

Emulsion B (example AgICl emulsion, 0.3M % I after 93% of Ag)

The emulsion was prepared similarly as Emulsion A, but with the following changes: After the accelerated flow rate of 87.1 mL/min was established, the silver jet addition was held at this rate for 35.7 min with pAg being held at 7.15, resulting in precipitation of 93 percent of the total silver to be introduced. At this point 200 mL of KI solution that contained 8.23 g KI was dumped into the reactor. The silver and chloride salt additions following the dump were continued as before the dump for another 3.5 min to provide a surface shell thickness of 186 Å. A total of 16.5 mole of AgCl containing 0.3M percent iodide was precipitated. The emulsion contained monodisperse tetradecahedral grains with an average grain size of 0.78 μm.

Emulsion C (example AgICl emulsion, 0.3M % I after 85% of Ag)

The emulsion was prepared similarly as Emulsion B, but with KI dump moved from following 93% of total silver addition to following 85% of total silver addition. Grain shapes and sizes were similar to those Emulsion B, but the surface shell thickness was increased to 432 Å.

Emulsion D (example AgICl emulsion, 0.2M % I after 93% of Ag)

The emulsion was prepared similarly as Emulsion B, but with the KI dump adjusted to provide 0.2M % I, based on total silver. Grain shapes, surface shell thicknesses and sizes were similar to those of Emulsion B.

Emulsion E (control AgICl emulsion, 0.3M % I during 6–93% of Ag)

The emulsion was prepared similarly as Emulsion B, but with the difference that the same amount of KI was introduced, starting after 6 percent of total silver had been precipitated and continuing until 93 percent of total silver had been introduced. Grain shapes, sizes and surface shell thicknesses were similar to those of Emulsion B.

Emulsion F (control cubic grain AgBrCl emulsion, 0.3M % Br after 93% of Ag)

The emulsion was prepared similarly as Emulsion B, but with the difference that KI was replaced with KBr.

The varied grain characteristics of Emulsion A–F are summarized in Table I.

TABLE I

| Emulsion | M % (I/Br) | Point of Addition (% ΣAg) | Primary Grain Shape | Mean Grain Size (mm) |
|---|---|---|---|---|
| A | 0 | not appl. | Cube | 0.78 |
| B | 0.3(I) | 93 | TDH | 0.78 |
| C | 0.3(I) | 85 | TDH | 0.82 |
| D | 0.2(I) | 93 | TDH | 0.78 |
| E | 0.3(I) | 6–93 | Cube | 0.78 |
| F | 0.3(Br) | 93 | Cube | 0.82 |

TDH = Tetradecahedron

Photographic Coatings

Emulsions A–F were chemically sensitized with 4.6 mg $Au_2S$ per Ag mole for 6 min at 40° C. Then at 60° C., the spectral sensitizing dye anhydro-5-chloro-3,3'-bis(3-sulfopropyl)naptho[1,2-d]thiazolothiacyanine hydroxide triethylammonium salt (Dye SS-1) in the amount of 220 mg/Ag mole and 103 mg/Ag mole of 1-(3-acetamidophenyl)-5-mercaptotetrazole (APMT) were added to the emulsions, which were then held at temperature for 27 minutes.

An important point to notice is that the conventional, more complicated and lengthy, AgBr epitaxial sensitization procedure was entirely eliminated.

The sensitized emulsions were identically coated on a photographic paper support. The coatings contained 260 mg/m$^2$ Ag;

1000 mg/m$^2$ yellow dye-forming coupler Y-1;

1770 mg/m$^2$ gelatin together with surfactant and hardener.

Sensitometry

Samples of the six coatings were exposed for 0.1 second to 365 nm line of from a Hg light source through a 1.0 neutral density filter and a 0 to 3.0 density (D) step tablet (ΔD=0.15). The exposed coatings were processed as recommended in "Using KODAK EKTACOLOR RA Chemicals", Publication No. Z-130, published by Eastman Kodak Co., 1990, hereinafter referred to as the RA process.

The sensitometric results of 365 nm line exposure are summarized in Table II.

TABLE II

| Emulsion | Relative Log Speed | Contrast | Dmin | Dmax |
|---|---|---|---|---|
| A | 100 | 2.8 | 0.09 | 2.49 |
| B | 125 | 2.7 | 0.11 | 2.46 |
| C | 120 | 2.7 | 0.08 | 2.50 |
| D | 115 | 2.5 | 0.11 | 2.34 |
| E | 97 | 2.8 | 0.08 | 2.57 |
| F | 100 | 2.7 | 0.06 | 2.51 |

Other samples of the same six coatings were exposed for 0.1 second to simulate exposure through a color negative film. These samples were exposed through a 0 to 3.0 density (D) step tablet (ΔD=0.15) to light in a Kodak Model 1B sensitometer with a color temperature of 3000° K which was filtered with a combination of a Kodak Wratten™ 2C plus a Kodak Color Compensating™ filter of 85 cc magenta plus a Kodak Wratten™ Color Compensating™ filter of 130 cc yellow plus a 0.3 neutral density filter. The exposed coatings were processed using the RA process cited above.

The sensitometric results of filtered white light exposure are summarized in Table III.

TABLE III

| Emulsion | Relative Log Speed | Contrast | Dmin | Dmax |
|---|---|---|---|---|
| A | 100 | 2.8 | 0.10 | 2.44 |
| B | 145 | 2.8 | 0.11 | 2.56 |
| C | 141 | 2.7 | 0.08 | 2.59 |
| D | 135 | 2.5 | 0.11 | 2.37 |
| E | 99 | 2.8 | 0.08 | 2.48 |
| F | 105 | 2.8 | 0.07 | 2.48 |

Discussion of Results

It is apparent from Table I that the introduction of iodide after most of the silver had been precipitated resulted in changing the shape of the grains from cubic to tetradecahedral. The emergence of {111} crystal faces while still retaining a cubical shape was unique to the addition of iodide. The shape of the grains of control Emulsion F was not changed from cubic by the introduction of bromide.

From Table II and III it is apparent example Emulsions B, C and D exhibited higher speeds than control Emulsion A (which lacked both iodide and bromide), control Emulsion E (which added iodide uniformly from a point early in the precipitation until late in the precipitation), and control Emulsion F (which substituted bromide for iodide). These comparisons demonstrate that the speed advantage observed was a function of the introduction of iodide and its location within the grains. Bromide, even if identically located, was ineffective to increase speed similarly, and iodide, if not introduced after at least half of the total silver had been precipitated as contemplated by this invention, was not effective to increase speed.

HIRF Observations

Samples of the coating of Emulsion B were exposed to a 1000 watt xenon arc lamp for varied exposure times set out in Table IV below through varied neutral density filters so that the product of exposure intensity and exposure time remained constant (see formula II set out above). The exposed coatings were processed using the RAprocess described above.

TABLE IV

| Exposure Time (sec) | Relative Log Speed* |
|---|---|
| 1.0 | 89 |
| 0.1 | 94 |
| 0.01 | 101 |
| 0.001 | 94 |
| 0.0001 | 91 |
| 0.00001 | 88 |

*Speed was measured at density of 0.55 above Dmin

From Table IV it is apparent that the silver iiodochloride emulsion of the invention exhibited very limited high intensity reciprocity failure (HIRF), even though no dopant was incorporated into the grains to reduce HIRF.

Example 2

This example compares {100} tabular grain emulsions with the emulsions of the invention.

Emulsion G (control {100} tabular grain AgICl emulsion 0.61M % I, 0.574M % I after 94% Ag)

This control emulsion demonstrates.the preparation of a high chloride {100} tabular grain emulsion containing 0.61 mole percent iodide of which 0.036 mole percent was present during nucleation, with the remainder present in an iodide band introduced following precipitation of 94 percent of total silver.

A 1.5 L solution containing 3.52% by weight of low methionine gelatin, 0.0056M sodium chloride and 0.3 mL of polyethylene glycol antifoamant was provided in a stirred reaction vessel at 40° C. While the solution was vigorously stirred, 45 mL of a 0.01M potassium iodide solution were added. This was followed by the addition of 50 mL of 1.25M silver nitrate and 50 mL of a 1.25M sodium chloride solution added simultaneously at a rate of 100 mL/min each. The mixture was then held for 10 seconds with the temperature remaining at 40° C. Following the hold, a 0.625M silver nitrate solution containing 0.08 mg mercuric chloride per mole of silver nitrate and a 0.625M sodium chloride solution were added simultaneously each at 10 mL/min for 30 minutes, followed by a linear acceleration from 10 mL/min to 15 mL/min over 125 minutes. The pCl was adjusted to 1.6 by running the 1.25M sodium chloride solution at 20 mL/min for 8 min. This was followed by a 10 minute hold then the addition of the 1.25M silver nitrate solution at 5 mL/minute for 30 minutes. This was followed by the addition of 16 mL of 0.5M KI and a 20 minute hold. Following the hold, the 0.625M silver nitrate and 0.625M sodium chloride solution were added simultaneously at 15 mL/min for 10 minutes to produce a surface shell thickness of 548 Å. The pCl was then adjusted to 1.6, and the emulsion was washed and concentrated using the procedures of Yutzy et al U.S. Pat. No. 2,614,918. The pCl after washing was 2.0. Twenty-one grams of low methionine gel were added to the emulsion. The pCl of the emulsion was adjusted to 1.6 with sodium chloride, and the pH of the emulsion was adjusted to 5.7.

The total elapsed time from grain nucleation to the termination of grain growth was 3 hours 53.2 minutes.

The mean ECD of the emulsion was 1.8 μm and the average grain thickness was 0.13 μm. The tabular grain projected area was approximately 85 percent of the total grain projected area.

Emulsion H (control cubic grain AgCl emulsion)

This emulsion was prepared to exhibit a mean grain volume matching that of Emulsion G.

To a stirred tank reactor containing 7.2 kg distilled water and 196 g bone gelatin, 185 mL 4.11M NaCl solution was added to adjust pAg to 7 at 68.3° C. The ripening agent 1,8-dihydroxy-3,6-dithiaoctane in the amount of 1.45 g was added to the reactor 30 seconds before pumping in 3.722M $AgNO_3$ at 45 mL/min and 3.8M NaCl salt solution at a rate needed to maintain constant pAg at 7. After 5 minutes the silver addition was accelerated from 45 mL/min to 85 mL/min within 15 minutes while the NaCl salt solution introduction was adjusted to maintain the pAg at 7. The silver solution addition remained at 85 mL/min for 17.85 min with the NaCl salt solution addition maintaining the pAg at 7. At that point the additions of both the silver and halide salt solutions to the reaction vessel were stopped.

A total of 10.11 moles of AgCl was precipitated in the form of edge rounded cubic grains having a mean grain size 0.70 μm. The mean grain volume matched that of Emulsion G.

Emulsion I (example tetradecahedral AgICl emulsion, 0.3M % I after 93% of Ag)

This emulsion was prepared to exhibit a mean grain volume matching that of Emulsion G.

To a stirred tank reactor containing 7.2 kg distilled water and 196 g bone gelatin, 185 mL 4.11M NaCl solution was added to adjust pAg to 7 at 68.3° C. The ripening agent 1,8-dihydroxy-3,6-dithiaoctane in the amount of 1.45 g was added to the reactor 30 seconds before pumping in 3.722M $AgNO_3$ at 45 mL/min and 3.8M NaCl salt solution at a rate needed to maintain constant pAg at 7. After 5 minutes the silver addition was accelerated from 45 mL/min to 85 mL/min within 15 minutes while the NaCl salt solution introduction was adjusted to maintain the pAg at 7. The silver solution addition remained at 85 mL/min for 15.3 min with the NaCl salt solution addition maintaining the pAg at 7. At that point 200 mL of KI that contained 4.98 g of KI was dumped into the stirred reaction vessel. The silver and chloride solution additions were conducted after the KI dump for another 2.55 minutes as they were conducted before the KI dump to produce a surface shell thickness of 169 Å.

Even with the inclusion of a 15 minute cooling down period following silver and halide salt solution introductions the total elapsed time from grain nucleation to the termination of grain growth was only 53.31 minutes. This demonstrates that the cubical grain silver iodochloride emulsions of the invention exhibit a marked advantage over tabular iodochloride grains, illustrated by the preparation of Emulsion G, in that a time savings in preparation of approximately 3 hours was realized. Notice that the comparison is based on the preparation of grains of equal volume in Emulsions G and I.

A total of 10.1 moles of AgCl was precipitated in the form of tetradecahedral grains having an mean grain size 0.71 μm.

Emulsion J (control {100} tabular grain AgICl emulsion, 0.1M % I, 0.064M % I after 94% of Ag)

The emulsion was prepared similarly as Emulsion G, but the total amount of silver precipitated reduced to produce a smaller grain size emulsion.

The mean ECD of the emulsion was 0.595 μm and the average grain thickness was 0.10 μm. The tabular grain projected area was approximately 85 percent of the total grain projected area. The surface shell thickness was 183 Å.

Emulsion K (control cubic grain AgCl emulsion)

The emulsion was prepared to provide grains of the same mean ECD as those of emulsion J.

A stirred reaction vessel containing 5.48 kg distilled water and 225 g bone gelatin was adjusted to a pAg of 7 at 68.3° C. by adding 4.11M NaCl solution. The ripening agent 1,8-dihydroxy-3,6-dithiaoctane in the amount of 1.44 g was added to the reaction vessel 30 seconds before initiating introduction of 2.0M $AgNO_3$ at 159 mL/min and 2.0M NaCl solution at a rate needed to maintain a constant pAg at 7. The simultaneous introduction of the silver and chloride salt solutions continued for 31.45 minutes with the pAg maintained at 7. Then the silver and chloride salt solution introductions were stopped.

A total of 10.0 moles of AgCl was precipitated in the form of edge rounded cubic grains having an mean grain size 0.46 μm.

Emulsion L (example tetradecahedral grain AgICl emulsion, 0.3M % I after 93% of Ag)

The emulsion was prepared to provide grains of the same mean ECD as those of emulsion J.

A stirred reaction vessel containing 5.48 kg distilled water and 225 g bone gelatin was adjusted to a pAg of 7 at 68.3° C. by adding 4.11M NaCl solution. The ripening agent 1,8-dihydroxy-3,6-dithiaoctane in the amount of 1.44 g was added to the reaction vessel 30 seconds before initiating introduction of 2.0M $AgNO_3$ at 159 mL/min and 2.0M NaCl solution at a rate needed to maintain a constant pAg at 7. The simultaneous introduction of the silver and chloride salt solutions continued for 29.25 minutes with the pAg maintained at 7. At that point 200 mL of KI that contained 5.05 g of KI was dumped into the stirred reaction vessel. The silver and chloride solution additions were conducted after the KI dump for another 2.0 minutes as they were conducted before the KI dump to produce a surface shell thickness of 143 Å. Then the silver and chloride salt solution introductions were stopped.

A total of 10.0 moles of AgCl was precipitated in the form of tetradecahedral grains having an mean grain size 0.596 μm.

Emulsion M (control cubic grain AgCl emulsion)

A reaction vessel containing 7.22 liters of a 2.8 percent by weight gelatin aqueous solution and 1.46 grams of 1,8-dihydroxy-3,6-dithiaoctane was adjusted to a temperature of 68° C, DH of 5.8, and a pAg of 7.2 by the addition of sodium chloride solution. A 3.72 molar aqueous solution of silver nitrate and a 3.8 molar aqueous solution of sodium chloride were simultaneously run into the reaction vessel with vigorous stirring at a constant flow rate of 0.317 mole/minute while the silver potential was controlled at 7.2 pAg. The emulsion was washed to remove excess salts.

A total of 9.8 moles of AgCl was precipitated in the form of cubic grains having an mean grain size 0.60 μm.

Photographic Coatings

Emulsions G–L were chemically sensitized with 4.6 mg $Au_2S$ per Ag mole for 6 min at 40° C. Then at 60° C., the spectral sensitizing dye Dye SS-1 in the amount of 220 mg/Ag mole and 103 mg/Ag mole of APMT were added to the emulsions, which were then held at temperature for 27 minutes.

A 1 mole sample of Emulsion M was heated to 40° C., and the pH and pAg adjusted to 4.55 and 7.6 with dilute nitric acid and potassium chloride respectively. A colloidal gold sulfide suspension ($9.9\times10^{-6}$ moles) was added and after 6 minutes the temperature raised to 60° C. A blue spectral sensitizing dye, SS-1 ($3.23\times10^{-4}$ mole) was added followed by the addition of $6.02\times10^{-4}$ mole of APMT. The emulsion was then held at temperature for 27 minutes. The addition of 0.67M % of aqueous KBr followed by a 15 minute hold completed the sensitization and after recrystallization the temperature was reduced to 40° C.

An important point to notice is that the addition of AgBr lengthened the chemical and spectral sensitization procedure for Emulsion M by 15 minutes. Since the emulsions of the invention do not require bromide epitaxy to realize maximum sensitivity, the emulsions of the invention can be chemically and spectrally sensitized more rapidly than conventional silver bromochloride emulsions in current use in color print photographic elements.

The sensitized emulsions were identically coated on a photographic paper support. The coatings contained 260 mg/m$^2$ Ag;

1000 mg/m$^2$ yellow dye-forming coupler Y1;

1770 mg/m$^2$ gelatin together with surfactant and hardener.

The varied grain characteristics of Emulsion G–M are summarized in Table V.

TABLE V

| Emul. | M % (I/Br) | Primary Grain Shape (% of Σ Proj. Area) | Mean Grain ECD x thickness (μm) | COV (%) |
|---|---|---|---|---|
| G | 0.61(I) | Tabular (84.8) | 1.8 × 0.13 | 71 |
| H | 0 | Cubic (99.9) | MGV = G | 19 |
| I | 0.3(I) | TDH (99.9) | MGV = G | 17 |
| J | 0.1(I) | Tabular (89.0) | 0.6 × 0.1 | 74 |
| K | 0 | Cubic (99.9) | ECD = J | 22 |
| L | 0.3(I) | TDH (99.9) | ECD = J | 19 |
| M | 0.6(Br) | Cubic (100) | ECD = 0.69 | 35 |

MGV = Mean Grain Volume
TDH = Tetradecahedron

From Table V it is apparent that the cubic and tetradecahedral grain emulsions exhibited a higher percentage of the total grain population of the desired shape. Additionally, the mean grain dispersity of the cubic and tetradecahedral grain emulsions was much lower than that of the tabular grain emulsions.

Improved Thermal Stability

Coated samples of Emulsions G, H, I and L were exposed to filtered white (2850° K) light and processed as described in Example 1, but with the variation that samples were exposed at 22° C. and 40° C. to compare differences in properties induced by the different temperatures of the samples at the time of exposure.

The results are summarized in Table VI.

TABLE VI

| Emul. | Relative Log Speed | | Dmin | |
|---|---|---|---|---|
| No. | 22° C. | 40° C. | 22° C. | 40° C. |
| G | 100 | 100 | 0.14 | 0.12 |
| H | 85 | 91 | 0.05 | 0.05 |
| I | 137 | 125 | 0.08 | 0.08 |
| M | 127 | 118 | 0.05 | 0.05 |

The silver iodochloride tetradecahedral emulsion, Emulsion I, exhibited a remarkable invariance of speed as function of varied exposure temperature. Its speed differed by only one relative log unit (0.01 log E). On the other hand, the silver iodochloride {100} tabular grain emulsion exhibited a speed variance of 13 relative log units (0.13 log E), which is nearly a half stop exposure difference. The cubic grain silver chloride emulsion, Emulsion H, exhibited an even larger variance in speed. The silver bromochloride emulsion, Emulsion M, exhibited a speed variance of 5 relative log units. Thus, the invention emulsion demonstrated a speed invariance superior to that of the best previously known comparable emulsions.

Matched Grain Volume Sensitometric Observations

When coated samples of Emulsions G, H and I were examined sensitometrically as described in Example 1, the following was observed:

The sensitometric results of 365 nm line exposure are summarized in Table VII.

TABLE VII

| Emulsion | Relative Log Speed | Contrast | Dmin | SH Density |
|---|---|---|---|---|
| G | 100 | 1.35 | 0.13 | 1.38 |
| H | 103 | 2.92 | 0.07 | 2.06 |
| I | 135 | 2.56 | 0.10 | 1.90 |

SH Density = The shoulder density observed at an exposure of 0.3 log E greater than the referenced speed point-i.e., where the density is equal to 1.0. E is exposure measured in lux-seconds.

The sensitometric results of filtered white light exposure are summarized in Table VIII.

TABLE VIII

| Emulsion | Relative Log Speed | Contrast | Dmin | SH Density |
|---|---|---|---|---|
| G | 100 | 1.26 | 0.14 | 1.36 |
| H | 71 | 3.04 | 0.07 | 2.12 |
| I | 121 | 2.64 | 0.11 | 2.64 |

It can be seen from the data in Table VII and VIII that on an equal grain volume basis, the silver iodochloride emulsions of the invention exhibit a higher speed than any of the remaining emulsions. As compared to the tabular grain emulsion, Emulsion G, minimum density is also lower and the shoulder density is higher.

Matched Grain ECD Sensitometric Observations

When coated samples of Emulsions J, K and L were examined sensitometrically as described in Example 1, the following was observed:

The sensitometric results of 365 nm line exposure are summarized in Table IX.

TABLE IX

| Emulsion | Relative Log Speed | Contrast | Dmin | SH Density |
|---|---|---|---|---|
| J | 100 | 1.86 | 0.11 | 1.65 |
| K | 111 | 2.49 | 0.07 | 1.85 |
| L | 160 | 2.57 | 0.08 | 1.88 |

The sensitometric results of filtered white light exposure are summarized in Table X.

TABLE X

| Emulsion | Relative Log Speed | Contrast | Dmin | SH Density |
|---|---|---|---|---|
| J | 100 | 1.20 | 0.12 | 1.34 |
| K | 97 | 2.75 | 0.08 | 2.03 |
| L | 152 | 2.63 | 0.08 | 1.90 |

From Tables IX and X it is apparent that the silver iodochloride emulsion, Emulsion L, was much faster in speed than either a comparable tabular grain emulsion of the same mean ECD, Emulsion J, or a comparable cubic grain emulsion of the same mean ECD, Emulsion K.

Rate of Development Comparisons

Coated samples of Emulsions G and I were exposed to 3000° K light and developed as described in Example 1, except that different samples were developed for either 45 or 90 seconds. Using the density produced by exposure through the middle step of 0 to 3.0 density step tablet, the silver densities at the two development times were used to calculate the rate of silver development.

For the silver iodochloride {100} tabular grain emulsion, Emulsion G, the rate oE development was 11.51 mg/m$^2$ Ag developed over the 45 second interval from 45 to 90 seconds of development.

For the silver iodochloride cubical grain emulsion, Emulsion I, of the invention the rate development was 80.38 mg/m$^2$ Ag developed over the 45 second interval from 45 to 90 seconds of development.

Thus, over the development interval measured, the rate of development of Emulsion I, satisfying the requirements of the invention, was approximately 7 times faster than the rate of development of the comparable tabular grain emulsion.

Example 3

This example compares emulsions according to the invention which are prepared with iodide introduction continued over a period of silver ion introduction and those which are prepared by iodide addition during an interruption in silver ion introduction.

Emulsion N (example AgICl emulsion, 0.24M % I after 93% Ag

To a stirred reaction vessel containing 4.5 Kg distilled water and 170.4 g bone gelatin, 26.95 g NaCl salt was added to adjust pAg to near 7.15 at 68.3° C. Then 1.40 g 1,8-dihydroxy-3,6-dithiaoctane were added to the reaction vessel 30 seconds before pumping in 1.35M $AgNO_3$ at 54 mL/min and 1.8M NaCl at a rate needed to maintain a constant pAg of 7.15. After 5 minutes the silver stream was accelerated from 54 mL/min to 158.5 mL/min over a period of 19 minutes while the NaCl salt stream addition was also accelerated to maintain pAg at 7.15. At this point 200 mL KI solution that contained 4.22 g KI was introduced into the stirred reaction vessel. The silver and NaCl salt stream introductions were then continued at their prior rate for another 5.8 min to produce a surface shell thickness of 244 Å. Then both the silver and NaCl salt streams were stopped.

A total 10.54 moles of AgICl were precipitated in the form of tetradecahedral grains having a mean grain size of 1.02 μm.

Emulsion P (control AgICl emulsion, 0.49M % I run in with final 7% Ag)

To a stirred reaction vessel containing 4.5 Kg distilled water and 170.4 g bone gelatin, 26.95 g NaCl salt was added to adjust pAg to near 71.5 at 68.3° C. Then 1.40 g 1,8-dihydroxy-3,6-dithiaoctane were added to the reaction vessel 30 seconds before pumping in 1.35M $AgNO_3$ at 54 mL/min and 1.8M NaCl at a rate needed to maintain a constant pAg of 7.15. After 5 minutes the silver stream was accelerated from 54 mL/min to 158.5 mL/min over a period of 30.6 minutes while the NaCl salt stream addition was also accelerated to maintain pAg at 7.15. At this point 1.8M NaCl solution modified to contain 7M % NaI, based on total halide. Introduction of the silver salt solution was then continued for 3.6 minutes using the modified, NaICl, salt solution to maintain pAg at 7.15. Then introductions of both solutions were stopped.

A total 10.54 moles of AgICl were precipitated in the form of tetradecahedral grains having a mean grain size of 1.0 μm.

Photographic Coatings and Sensitometry

The emulsions were sensitized, coated and exposed to 3000° K light and processed as described in Example 1.

The results are summarized in Table XI.

TABLE XI

| Emul | M % I | Point of Addition (% ΣAg) | Relative Log Speed | Dmin | Contrast |
|---|---|---|---|---|---|
| N | 0.24 | 93% | 100 | 0.08 | 2.39 |
| P | 0.49 | 93–100% | 105 | 0.10 | 2.21 |

From Table XI it is apparent that it required twice the level of total iodide to obtain comparable performance when the iodide was introduced with the final 7 percent of silver rather than being added after 93 percent of the silver had been introduced and before the remaining 7 percent of silver was introduced. A higher minimum density and lower contrast was observed when the iodide was added with the final 7 percent of the silver. The doubled iodide content required to reach a similar speed rendered control Emulsion P inferior to example Emulsion N. In reflection print photographic elements the 0.02 higher Dmin produced by Emulsion P represents a significant performance disadvantage.

Example 4

This example demonstrates the effect of selected dopants on the performance of the emulsions of the invention.

Emulsion Q

The preparation of Emulsion B was repeated, except that an aqueous solution containing $8.25\times10^{-4}$ mole of $K_4Ru$ $(CN)_6$ was added during the precipitation during the period of time when the grains were being grown from 75 to 80 percent of their final volume.

Emulsion R

The preparation of Emulsion B was repeated, except that an aqueous solution of containing $5.94\times10^{-8}$ mole of $Cs_2OsNOCl_5$ was added during the precipitation during the period of time when the grains were being grown from 0 to 70 percent of their final volume.

Emulsion S

The preparation of Emulsion B was repeated, except that an aqueous solution of containing $1.28\times10^{-7}$ mole of $K_2IrCl_6$ was added during the precipitation during the period of time when the grains were being grown from 95 to 97 percent of their final volume.

Photographic Coatings and Sensitometry

Samples of Emulsions B, Q, R and S were sensitized, coated, exposed to 3000° K light and processed as described in Example 1, except as otherwise indicated.

Samples of Emulsions B and Q, when exposed at 0.01 second, exhibited relative speeds of 100 and 109, respectively, demonstrating a clear speed enhancement attributable to the ruthenium shallow electron trapping (SET) dopant.

Samples of Emulsions B and R exhibited contrasts of 2.52 and 3.39, respectively, demonstrating a marked increase in contrast attributable to the presence of the osmiumnitrosyl (NZ) dopant.

Comparisons of samples of Emulsions B and S are shown below.

TABLE XII

| | Rel. Log Speed @ exposures of | | Δ Log | Contrast @ exposures of | | Δ |
|---|---|---|---|---|---|---|
| Emul. | 0.01" | 0.1" | Speed | 0.01" | 0.1" | Contrast |
| B | 100 | 108 | 8 | 2.47 | 2.70 | 0.23 |
| S | 95 | 95 | 0 | 2.82 | 2.82 | 0 |

The results in Table XII demonstrate that the iridium dopant eliminated both speed and contrast reciprocity failure.

Example 5

This example has as its purpose to demonstrate the effects produced by blended silver chloride and silver bromide emulsions.

The following emulsions were provided:

Emulsion X

A silver bromide Lippmann emulsion having a mean grain size of 0.08 Brawas provided.

Emulsion Y

A silver chloride Lippmann emulsion having a mean grain size of just less than 0.10 μm was provided.

Emulsions T and U

Remakes of Emulsions A (cubic grain AgCl) and B (tetradecahedral grain AgICl), Emulsions T and U, respectively, were chemically sensitized by adjusting its pH to 5.6 with 10% nitric acid solution and adjusting its pAg to 7.2 with a potassium chloride solution at 40° C. Blue spectral sensitizing dye SS-1 was added in the amount of 220 mg of dye per mole of silver, followed 20 minutes later by the addition of colloidal gold sulfide in the amount of 5.0 mg of gold per mole of silver. The temperature of the emulsion was then raised from 40° C. to 60° C. at a rate of 5° C. per 3 minute interval. After reaching 60° C., the emulsion was held for 20 minutes before the addition of 91 mg APMT/Ag mole. The emulsion was stirred for 20 minutes and the cooled before a sample was taken for coating.

Photographic Coatings

Several photographic coatings were prepared using radiation-sensitive emulsions T or U and varying the Lippmann emulsion incorporation. The following is a general summary of the common features of the photographic elements formed:

| Element Feature | Feature Components | Coverage ($mg/m^2$) |
|---|---|---|
| Overcoat | Gelatin | 1076 |
| | Hardener | 106 |
| | SF-1 | 8.3 |
| | SF-2 | 3.0 |
| Emulsion Layer Unit | Emulsion Q | 280 |
| | Lippmann | varied |
| | Coupler Y-1 | 1076 |
| | Coupler Solvent S-1 | 355 |
| | Aux. Solvent | 258 |
| | Gelatin | 1614 |
| Undercoat | Gelatin | 3228 |
| Support | Two-sided polyester resin coated paper support | |

Hardener = Bis (vinylsulfonylmethyl) ether;
SF-1 = Alkanol XC ™, Sodium isopropylnapthylsulfonate;
SF-2 = Sodium perfluorooctylsulfonate;
Aux. Solv. = 2-(2-Butoxyethoxy)ethyl acetate.

The coatings were varied in the following respects: (1) the choice of the Lippmann emulsion (X, Y or none); (2) the concentration of the Lippmann emulsion; and (3) the point of addition of the Lippmann. For choice (3) two alternatives were investigated: Either the Lippmann was added to Emulsion T or U immediately following its sensitization, hereinafter referred to as emulsion addition, or the Lippmann was combined with Emulsion T or U at the same time as Coupler Y-1 dispersion just before coating, hereinafter referred to as dispersion addition.

Sensitometry

The coatings were exposed to 3000° K light and processed as described in Example 1, but with this difference: To assess the sensitivity of each emulsion combination towards processing, the time of development was varied in 15 second increments. The standard development time of 45 seconds (Example 1) was obtained as well as sample coatings developed for 30 seconds and 60 seconds. After processing, the Status A reflection density of each sample was measured as a function of exposure (log E). From this sensitometric data, the speed (sensitivity) of each coating sample was calculated, and the minimum density (Dmin) was also measured.

To determine the sensitivity of the various samples towards processing, the difference in the emulsion speed measured at 60 seconds and 30 seconds was calculated and divided by the processing time change of 30 seconds. This result then, is the rate of speed change per second, centered about the recommended processing time. A similar calculation was used to determine the rate of Dmin change.

The results employing Lippmann emulsion Y (AgCl) are summarized in Table XIII.

TABLE XIII

| Emulsions | Lippmann Coverage ($mg/m^2$) | Δ Log Speed per second | Δ Dmin per second ($\times 10^4$) |
|---|---|---|---|
| T | 0 | 43 | 4.0 |
| U | 0 | 50 | 20 |
| U + Y Emul. | 10.8 | 43 | 10 |
| U + Y Emul. | 53.8 | 50 | 26 |
| U + Y Emul. | 108.0 | 70 | 52 |
| U + Y Disp. | 10.8 | 37 | 7.0 |
| U + Y Disp. | 53.8 | 43 | 7.0 |
| U + Y Disp. | 108.0 | 40 | 7.0 |

The data in Table XIII show that the photographic element that employed only a tetradecahedral grain silver iodochloride emulsion was more susceptible to variations in speed and, particularly, minimum density than the photographic element that employed only a corresponding cubic grain silver chloride emulsion. The advantage of the silver iodochloride emulsion was increased speed, demonstrated in Example 1.

When the silver chloride Lippmann emulsion, Emulsion Y, was added to the emulsion layer, either after sensitization of the silver iodochloride emulsion (Y-Emul) or with the dye-forming coupler dispersion just before coating (Y-Disp), the susceptibility of the silver iodochloride emulsion to minimum density increases is reduced. When the Lippmann was added to the emulsion after sensitization, its effectiveness was limited to the lowest level of incorporation reported, but, when the Lippmann was added to the silver iodochloride emulsion just before coating, the effectiveness of the Lippmann was independent of its concentration.

Thus, the data in Table XIII demonstrate that the higher sensitivity advantage of the silver iodochloride emulsions can be retained while reducing minimum density levels that they would otherwise produce by the addition of the silver chloride Lippmann emulsion.

When Lippmann Emulsion X (AgBr) was substituted for Lippmann Emulsion Y (AgCl) the results were observed summarized in Table XIV.

TABLE XIV

| Emulsions | Lippmann Coverage ($mg/m^2$) | Δ Log Speed per second | Δ Dmin per second ($\times 10^4$) |
|---|---|---|---|
| T | 0 | 43 | 4.0 |
| U | 0 | 50 | 20 |
| T + X Emul. | 10.8 | 33 | 25 |
| T + X Emul. | 21.6 | 50 | 45 |
| T + X Emul. | 53.8 | 130 | 78 |
| T + X Disp. | 10.8 | 40 | 5.0 |
| T + X Disp. | 21.6 | 40 | 10.0 |
| T + X Disp. | 53.8 | 43 | 8.0 |

The results in Table XIV demonstrate that the silver bromide Lippmann was effective to reduce speed variance at low concentrations when incorporated in Emulsion R after sensi.tization. However, the AgBr Lippmann did not effectively reduce minimum density variance. On the other hand, when incorporated in the silver iodochloride emulsion just before coating (X Disp), the AOBr Lippmann emulsion appeared to be as quite effective in reducing the levels of minimum density.

Examples 6–10

Examples 6–10 have as their purpose to demonstrate the effects of selected antifoggants.

Example 6

A silver iodochloride (0.3M % I) emulsion was prepared similarly as Emulsion B, but with a mean grain size of 1.1 μm. The emulsion was chemically sensitized with a colloidal dispersion of aurous sulfide at 4.0 mg/Ag mol for 6 min at 40° C. at a pH of 4.5 and a pAg of 7.7. The temperature was raised to 60° C. and kept for 20 min at which time blue spectral sensitizing dye SS-1 (176 mg/Ag mol) was added followed by a 10 min hold. The emulsion was cooled to 40° C. and an antifoggant was either added or not added, as described below. This blue sensitized silver iodochloride negative-working emulsion further contained as coated on a resin coated photographic paper support a yellow dye-forming coupler Y-1 (1000 $mg/m^2$) in coupler solvent S-1 (270 $mg/m^2$) and gelatin (1770 mg/m2). The emulsion layer (279 mg $Ag/m^2$) was overcoated with 1076 $mg/m^2$ gelatin containing the hardener bis(vinylsulfonylmethyl) ether in an amount of 1.8% by weight, based on total gelatin in the emulsion and overcoat layers.

Coated samples, differing in antifoggant content, were exposed to filtered white light (3000° K) and processed as described in Example 1.

Table XV illustrates the utility of Formula A antifoggants in the silver iodochloride tetradecahedral grain emulsions of the invention. Under accelerated keeping conditions, coatings containing these antifoggants exhibited less change in fog relative to the control, which contained no antifoggant.

TABLE XV

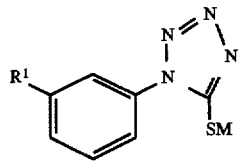

A

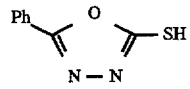

A10

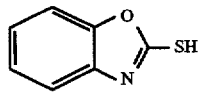

A11

| Code | $R^1$ | M |
|---|---|---|
| A1 | $-NHCOCH_3$ | H |
| A2 | $-H$ | H |
| A3 | $-OMe$ | H |
| A4 | $-NHCONH_2$ | H |
| A5 | $-NHCONHCH_2COOH$ | H |
| A6 | $-NHCOCOOEt$ | H |
| A7 | $-NHCOPh$ | H |
| A8 | $-SO_3^- Na^+$ | H |
| A9 | $-H$ | Ag |

| Code | mmol/Ag mol | 1 week 37.8 vs −17.8° C. Δ Fog | 2 weeks 37.8 vs −17.8° C. Δ Fog |
|---|---|---|---|
| Cntrl | 0 | 1.087 | 1.567 |
| A1 | 0.29 | 0.261 | 0.543 |
| A1 | 0.48 | 0.273 | 0.545 |
| A2 | 0.29 | 0.252 | 0.517 |

TABLE XV-continued

| | | | |
|---|---|---|---|
| A2 | 0.48 | 0.221 | 0.519 |
| A3 | 0.29 | 0.196 | 0.473 |
| A3 | 0.48 | 0.218 | 0.501 |
| A4 | 0.29 | 0.282 | 0.521 |
| A4 | 0.48 | 0.282 | 0.546 |
| A5 | 0.29 | 0.680 | 0.936 |
| A5 | 0.48 | 0.642 | 0.944 |
| A6 | 0.29 | 0.513 | 0.923 |
| A6 | 0.48 | 0.328 | 0.609 |
| A7 | 0.29 | 0.269 | 0.567 |
| A7 | 0.48 | 0.227 | # |
| A8 | 0.29 | 0.260 | 0.552 |
| A8 | 0.48 | 0.275 | 0.579 |
| A9 | 0.29 | 0.211 | 0.484 |
| A9 | 0.48 | 0.225 | 0.489 |
| A10 | 0.19 | 0.053 | 0.178 |
| A10 | 0.38 | 0.022 | 0.096 |
| A11 | 0.19 | 0.095 | 0.294 |
| A11 | 0.38 | 0.134 | 0.311 |

Missing coating

Example 7

Example 6 was repeated, except that the chalcogenazolium salts satisfying Formula B listed below were added to the emulsion.

TABLE XVI

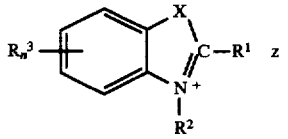

(B)

| Code | X | $R^3$ | $R^1$ | Z | $R^2$ |
|---|---|---|---|---|---|
| B1 | S | H | H | $BF_4^-$ | $-CH_2CH_2CONHSO_2Me$ |
| B2 | S | H | H | $Br^-$ | $-(CH_2)_{10}$-3-benzothiazolyl |
| B3 | S | H | H | $HSO_4^-$ | $-Me$ |
| B4 | S | H | H | $BF_4^-$ | $-CH_2CH=CH_2$ |
| B5 | S | OMe | H | | $-CH_2CH_2CH_2SO_3^-$ |
| B6 | Se | H | Me | $pts^-$ | $-Et$ |

| Code | mmol/Ag mol | 1 week 37.8 vs −17.8° C. Δ Fog | 2 weeks 37.8 vs −17.8° C. Δ Fog |
|---|---|---|---|
| None | 0 | 1.355 | 1.715 |
| B1 | 0.29 | 0.170 | 0.327 |
| B1 | 0.48 | 0.095 | 0.160 |
| B2 | 0.29 | 0.679 | 1.112 |
| B2 | 0.48 | 0.634 | 1.041 |
| B3 | 0.29 | 0.558 | 0.944 |
| B3 | 0.48 | 0.453 | 0.939 |
| B4 | 0.29 | 0.690 | 1.171 |
| B4 | 0.48 | 0.679 | 1.170 |
| B5 | 0.29 | 0.655 | 1.012 |
| B5 | 0.48 | 0.671 | 0.996 |
| B6 | 0.29 | 0.235 | 0.513 |
| B6 | 0.48 | 0.208 | 0.475 |

Table XVI illustrates the benefits of Formula B chalcogenazolium salts in reducing the fog growth of the cubic iodochloride emulsion relative to the control.

Example 8

Example 6 was repeated, except that antifoggants satisfying Formula C were added to the emulsion.

TABLE XVII

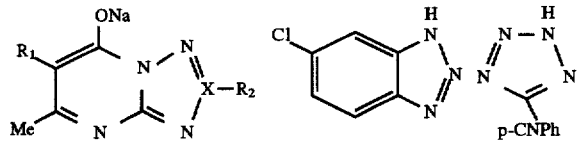

C C5 C6

| Code | $R_1$ | $R_2$ | x |
|---|---|---|---|
| C1 | H | H | C |
| C2 | Br | H | C |
| C3 | H | MeS | C |
| C4 | H | — | N |

| Code | mmol/Ag mol | 1 week 37.8 vs −17.8° C. Δ Fog | 2 weeks 37.8 vs −17.8° C. Δ Fog |
|---|---|---|---|
| Cntrl | 0 | 1.090 | 1.585 |
| C1 | 4.8 | 0.058 | 0.138 |
| C1 | 12 | 0.062 | 0.139 |
| C2 | 4.8 | 0.120 | 0.140 |
| C2 | 12 | 0.006 | 0.065 |
| C3 | 4.8 | 0.259 | 0.263 |
| C3 | 12 | 0.093 | 0.127 |
| C4 | 4.8 | 0.187 | 0.814 |
| C4 | 12 | 0.142 | 0.556 |
| C5 | 4.8 | 0.261 | 0.356 |
| C5 | 12 | 0.133 | 0.142 |
| C6 | 4.8 | 0.079 | 0.158 |
| C6 | 12 | 0.077 | 0.162 |

The results in Table XVII show that the nitrogen compounds with dissociable protons are effective in reducing the changes in fog under accelerated keeping conditions.

Example 9

Example 6 was repeated, except that dichalcogenides satisfying Formula D were added to the emulsion. Table XVIII illustrates the advantage of these compounds as stabilizers for the silver iodochloride emulsions. The dichalcogenides, including disulfides, diselenides, and ditellurides are effective in suppressing fog growth.

TABLE XVIII

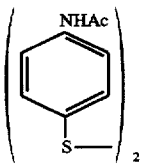

D1

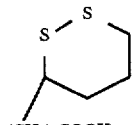

D2

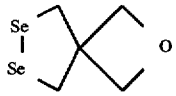

D3

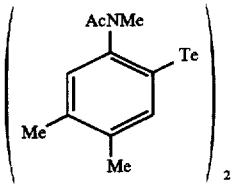

D4

| Code | mmol/Ag mol | 1 week 37.8 vs −17.8° C. Δ Fog | 2 weeks 37.8 vs −17.8° C. Δ Fog |
|---|---|---|---|
| Cntrl | 0 | 1.641 | 1.776 |
| D1 | 0.29 | 0.166 | 0.503 |
| D2 | 0.02 | 0.980 | 1.138 |
| D3 | 0.02 | 0.083 | 0.055 |
| D4 | 0.02 | 0.039 | 0.034 |

Example 10

While the preceding Examples employ only one antifoggant, combinations of addenda can be more effective as antifoggants than a single compound. This is demonstrated by the incorporation of APMT alone and in combination with compounds with enolic groups listed below.

Example 6 was repeated, except that the compounds shown in XIX were added to the emulsion.

TABLE XIX

| Code | mmol/ Ag mol | 1-week 37.8 vs −17.8° C. Δ Speed | Δ Fog | 2-weeks 37.8 vs −17.8° C. Δ Speed | Δ Fog |
|---|---|---|---|---|---|
| Cntrl | 0 | * | 1.641 | * | 1.776 |
| APMT | 0.29 | 13.9 | 0.166 | 28.5 | 0.503 |
| APMT + PHR | 2.5 | 2.5 | 0.006 | 9.4 | 0.015 |
| APMT + CDS | 30 | 9.9 | 0.020 | 16.2 | 0.079 |
| APMT + HQ | 14 | 7.3 | 0.014 | 13.2 | 0.027 |
| APMT + MOP | 4 | 4.0 | 0.007 | 5.3 | −0.003 |

*fog was too high to measure speed

Table XIX shows further reductions in fog growth and speed stabilization by employing in combination with APMT piperidino hexose reductone (PHR), 4,5-dihydroxybenzene-1,3-disulfonic acid disodium salt (CDS), hydroquinone (HQ) and 4-(hydroxymethyl)-4-methyl-1-phenyl-3-pyrazolidinone (MOP).

Example 11

This example demonstrates (1) the correlation between the stimulatedlfluorescent emission profile, (2) photographic speed at matched minimum densities, and (3) the presence or absence iodide as well as iodide ion distribution within the grains.

Emulsion AA (control cubic grain AgCl emulsion)

A stirred tank reactor containing 5.7 Kg distilled water and 225 g of bone gelatin and 225 g 2M NaCl solution was adjusted to a pAg of 7.55 at 46° C. 1,8-Dihydroxy-3,6-dithiaoctane in the amount of 0.66 g was added to the reactor 30 seconds before the double jet addition of 2M $AgNO_3$ at 159.0 mL/min and 2.0M NaCl at a rate controlled to maintain a constant pAg of 7.55. The silver jet addition rate remained at 159.0 mL/min for 31.45 minutes while the pAg was held at 7.55. A total of 10 mole of AgCl was precipitated in the form of a monodisperse cubic grain emulsion having a mean grain size of 0.34 μm.

Emulsion BB (example AgICl emulsion, 0.3M % dump I after 93% of Ag)

This emulsion was prepared similarly as Emulsion AA, but with the following changes: After the silver jet was held at 159 mL/min for 29 minutes with pAg being held at 7.55, resulting in precipitation of 93 percent of the total silver to be introduced, 200 mL of KI solution that contained 5.05 g KI was dumped into the reactor. The silver and chloride salt additions following the dump were continued as before the dump for another 2.2 minutes to form a surface shell of 81 Å in thickness. A total of 10 mole of AgICl containing 0.3 mole percent iodide, based on silver, was precipitated. The emulsion contained monodisperse cubic grains with an average grain size of 0.34 μm.

Emulsion CC (control AgICl emulsion, 0.3M % run I 75–100% of Ag)

This emulsion was prepared similarly as Emulsion BB, including introduction of the same amount of KI, but with the distribution of iodide being modified. KI addition was begun after 75 percent of the total silver had been precipitated (23.6 minutes after the initiation of the 159 mL/min silver jet) and continued until 100 percent of the total silver halide been introduced. A total of 10 mole of AgICl containing 0.3 mole percent iodide, based on silver, was precipitated. The emulsion contained monodisperse cubic grains with an average grain size of 0.34 μm.

Emulsion DD (control AgICl emulsion, 0.3M % run I 93–100% of Ag)

This emulsion was prepared similarly as Emulsion CC, including introduction of the same amount of KI, but with the distribution of iodide being modified. KI addition was begun after 93 percent of the total silver had been precipitated (29.24 minutes after the initiation of the 159 mL/min silver jet) and continued until 100 percent of the total silver halide been introduced. A total of 10 mole of AgICl containing 0.3 mole percent iodide, based on silver, was precipitated. The emulsion contained monodisperse cubic grains with an average grain size of 0.34 μm.

Emulsion EE (control AgICl emulsion, 0.3M % run I 5–100% of Ag)

This emulsion was prepared similarly as Emulsion CC, including introduction of the same amount of KI, but with the distribution of iodide being modified. KI addition was begun after 5 percent of the total silver had been precipitated (14.1 minutes after the initiation of the 159 mL/min silver jet) and continued until 100 percent of the total silver halide been introduced. A total of 10 mole of AgICl containing 0.3 mole percent iodide, based on silver, was precipitated. The emulsion contained monodisperse cubic grains with an average grain size of 0.33 μm.

The varied grain characteristics of the emulsions above are summarized in Table XX.

TABLE XX

| Emulsion | M % I | Point of Addition (% ΣAg) | Primary Grain Shape | Mean Grain Size (μm) |
|---|---|---|---|---|
| AA | 0 | not appl. | Cube | 0.34 |
| BB | 0.3 (I) | 93 | Cube | 0.34 |
| CC | 0.3 (I) | 75–100 | Cube | 0.34 |
| DD | 0.3 (I) | 93–100 | Cube | 0.34 |
| EE | 0.3 (I) | 5–100 | Cube | 0.33 |

Fluorescent Emission Spectra

Samples of the above emulsions were exposed to 390 nm electromagnetic radiation at 10° K to stimulate fluorescent emission. Emission intensity at the reference wavelength (Rλ) of 500 nm was measured and, when iodide was present, peak emission intensity in the wavelength range of from 450 to 470 nm attributable to iodide (Iλ) was measured. These results was well as the ratio of Iλ:Rλ are reported and compared to the iodide introductions in Table XXI below.

TABLE XXI

| Emulsion | M % I | Point of Addition (% ΣAg) | Rλ | Iλ | Iλ/Rλ |
|---|---|---|---|---|---|
| AA | 0 | not appl. | 0.1318 | 0.195 | 1.48 |
| BB | 0.3 (I) | 93 | 0.4780 | 1.01 | 2.11 |
| CC | 0.3 (I) | 75–100 | 0.3019 | 0.65 | 2.15 |
| DD | 0.3 (I) | 93–100 | 0.2764 | 0.82 | 2.97 |
| EE | 0.3 (I) | 5–100 | 0.5580 | 1.54 | 2.75 |

From Table XXI it is apparent that peak emission intensity in the range of from 450 to 470 nm significantly exceeds emission intensity at the reference wavelength of 500 in all the emulsions containing iodide.

Photographic Coatings

The emulsions above were chemically sensitized with 20.0 mg $Au_2S$ per Ag mole for 2 min at 40° C. Then at 55° C., the spectral sensitizing dye anhydro-5-chloro-9-ethyl-5'-phenyl-3'-(3-sulfobutyl)-3-(3-sulfopropyl)oxacarbocyanine hydroxide triethylammonium salt (Dye SS-21) in the amount of 443.4 mg/Ag mole and 162 mg/Ag mole of APMT were added to the emulsions, which were then held at temperature (55° C.) for times varied as required to produce a minimum density of 0.11–0.12.

An important point to notice is that the conventional, more complicated and lengthy, AgBr epitaxial sensitization procedure was entirely eliminated.

The sensitized emulsions were identically coated on a photographic paper support. The coatings contained 60 mg/$m^2$ Ag;

400 mg/$m^2$ magenta dye-forming coupler M-1;

770 mg/$m^2$ gelatin together with surfactant and hardener.

Sensitometry

Samples of the five coatings were exposed for 0.1 second to 365 nm line of from a Hg light source through a 1.0 neutral density filter and a 0 to 3.0 density (D) step tablet (ΔD=0.15). The exposed coatings were processed as recommended in "Using KODAK EKTACOLOR RA Chemicals", Publication No. Z-130, published by Eastman Kodak Co., 1990, hereinafter referred to as the RA process.

The sensitometric results of 365 nm line exposure are summarized in Table XXII.

TABLE XXII

| Emulsion | M % I | Point of Addition (% ΣAg) | Dmin | Rel. Speed | Iλ/Rλ |
|---|---|---|---|---|---|
| AA | 0 | not appl. | 0.11 | 100 | 1.48 |
| BB | 0.3 (I) | 93 | 0.12 | 121 | 2.11 |
| CC | 0.3 (I) | 75–100 | 0.12 | 117 | 2.15 |
| DD | 0.3 (I) | 93–100 | 0.11 | 115 | 2.97 |
| EE | 0.3 (I) | 5–100 | 0.11 | 111 | 2.75 |

From Table XXII it is apparent that the highest observed speed was produced by Emulsion BB, which satisfies the requirements of the invention. Although Emulsions CC, DD and EE also satisfied the stimulated fluorescent emission indicative of iodide incorporation, their speeds were significantly lower. This is attributed in part to the presence of iodide at the surface of the grains. Had the final melt hold of sensitization been extended, these emulsions might have reached the same speed levels as Emulsion BE, but their Dmin values would have been excessively high.

Example 12

This example demonstrates modifications of performance in the emulsions of the invention that can be realized by incorporating combinations of dopants into the grains.

Emulsion FF (control cubic grain AgCl emulsion; no iodide, no dopant)

To a stirred reaction vessel containing 4.5 Kg of distilled water and 170.4 g of bone gelatin, 26.95 g of NaCl were added to adjust the pAg to near 7.15 at 68.3° C. Then, 1.40 g of 1,8-dihydroxy-3,6-dithiaoctane were added to the reaction vessel 30 seconds before pumping in 1.35M $AgNO_3$ at 54 mL/min. and 1.8M NaCl at a rate needed to maintain a constant pAg of 7.15. After 5 minutes, the silver stream was accelerated from 54 mL/min to 158.5 mL/min over a period of 24.8 minutes. The NaCl stream was also accelerated, but at a rate required to maintain a DAg of 7.15. The emulsion was subsequently ultra-filtered to remove excess salts.

The grains thus precipitated were found to be generally cubic in nature, to have a mean grain edge length of 1.03 μm, and to be monodisperse. A total of 10.54 moles of emulsion were precipitated.

Emulsion GG (example AgICl emulsion, no dopants, 0.3M % I after 93% of Ag)

To a stirred reaction vessel containing 4.5 Kg of distilled water and 170.4 g of bone gelatin, 26.95 g of NaCl were added to adjust the pAg to near 7.15 at 68.3° C. Then, 1.40 g of 1,8-dihydroxy-3,6-dithiaoctane was added to the reaction vessel 30 seconds before pumping in 1.35M $AgNO_3$ at 54 mL/min and 1.8M NaCl at a rate needed to maintain a constant pAg of 7.15. After 5 minutes, the silver stream was accelerated from 54 mL/min. to 158.5 ml/min. over a period of 19 minutes. The NaCl stream was also accelerated, but at a rate required to maintain a pAg of 7.15. At this point, a solution of 5.25 g of KI in water was added into the reaction vessel. The silver and salt streams continued at their prior rate for an additional 5.8 minutes, then were stopped to provide a surface shell thickness of 220 Å. The emulsion was subsequently ultra-filtered to remove excess salts. The grain thus precipitated, was found to be generally cubic in nature, but to show some evidence of tetradecahedral character, to have a mean grain edge length of 0.92 μm, and to be monodisperse in character. A total of 10.54 moles of emulsion were precipitated.

Emulsion HH (example AgICl emulsion, $Ru(CN)_6$ and $IrCl_6$ dopants, 0.3M % I after 93% of Emulsion HH was precipitated in the same manner as Emulsion GG, except that a solution of $2.5\times10^{-5}$ mole of $K_4Ru(CN)_6$ (hereinafter designated RuCN, reflecting that ruthenium and the cyano ligands together account for dopant activity) per Ag mole was added to the emulsion during grain formation extending from 75% to 80% of the total silver addition and an acidic solution of $2.1\times10^{-9}$ mole of $K_2IrCl_6$ per Ag mole was added to the emulsion during grain formation extending from 95% to 97% of total silver addition. The ruthenium and cyano ligands

Emulsion II (example AgICl emulsion, $OsNOCl_5$ and $IrCl_6$ dopants, 0.3M % I after 93% of Ag)

Emulsion II was precipitated in the same manner as Emulsion GG, except that a solution of $9.0\times10^{-10}$ mole of $Cs_2OsNOCl_5$ (hereinafter designated OsNO, reflecting that osmium and the nitrosyl ligand together account for dopant activity) per Ag mole was added to the emulsion during grain formation extending from 0% to 70% of total silver addition and an acidic solution of $2.1\times10^{-9}$ mole of $K_2IrCl_6$ (hereinafter designated Ir, since the chloride ligands have only a secondary effect on dopant activity) per Ag mole was added to the emulsion during grain formation extending from 95% to 97% of the total silver addition.

Emulsion JJ (example AgICl emulsion, $Ru(CN)_6$ and $OsNOCl_5$ dopants, 0.3M % I after 93% of Ag)

Emulsion JJ was precipitated in the same manner as Emulsion GG, except that a solution of $9.0\times10^{-10}$ mole of $Cs_2OsNOCl_5$ (OsNO) per Ag mole was added to the emulsion during grain formation extending from 0% to 70% of the total silver addition and $2.5\times10^{-5}$ mole of $K_4Ru(CN)_6$) (RuCN) per Ag mole was added to the emulsion during grain formation extending from 75% to 80% of the total silver addition.

Emulsion KK (example AgICl emulsion, IrTz and $OsNOCl_5$ dopants, 0.3M % I after 93% of Emulsion KK was precipitated in the same manner as Emulsion GG, except that a solution of $9.0\times10^{-10}$ mole of $Cs_2OsNOCl_5$ (OsNO) per Ag mole was added to the emulsion during grain formation extending from 0% and 70% of the total silver addition and a solution of $4.9\times10^{-8}$ mole of $K_2IrCl_5$(thiazole) (hereafter referred to as IrTz) per Ag mole was added to the emulsion during grain formation extending from 95% to 97% of the total silver addition.

Photographic Coatings

These emulsions were subsequently given a chemical sensitization by adjusting the pH to 5.6 with 10% nitric acid solution and adjusting the pAg to 7.6 with sodium chloride solution, both at 40° C. Colloidal gold sulfide in the amount of $2.3\times10^{-6}$ mole per mole of silver was added and, after 5 minutes, the temperature of the emulsion was raised to 60° C. at a rate of 50° C. per 3 minute interval. A blue spectral sensitizing dye mixture, anhydro-3,3'-bis(3-sulfopropyl)-5-chloro-5'-pyrrolothiacyanine triethylammonium salt (Dye SS-52) at $2.83\times10^{-4}$ mole per Ag mole and anhydro-5'-chloro-5-phenyl-3,3'-bis(3-sulfopropyl)oxathiacyanine hydroxide, triethylammonium salt (Dye SS-29) at $7.2\times10^{-5}$ mole per Ag mole, was added 20 minutes after reaching 60° C. Subsequently a solution containing $4.38\times10^{-4}$ mole per Ag mole of APMT was added. For comparison, one portion of Emulsion FF received the addition of 0.67M % of aqueous KBr followed by a 15 minute hold. Each emulsion was cooled to 40° C., completing the chemical and spectral sensitization.

Each sensitized emulsion was then evaluated in the following coating format:

| Element Feature | Feature Components | Coverage ($mg/m^2$) |
|---|---|---|
| Overcoat | Gelatin | 1076 |
| | Hardener | 106 |
| | SF-1 | 8.3 |
| | SF-2 | 3.0 |
| Emulsion Layer Unit | Emulsion | 280 |
| | Coupler Y-1 | 1076 |
| | Coupler Solvent S-1 | 355 |
| | Stabilizer ST-6 | 258 |
| | Aux. Solvent | 301 |
| | Gelatin | 1614 |
| Undercoat | Gelatin | 3228 |
| Support | Two-sided polyester resin coated paper support | |

Hardener = Bis(vinylsulfonylmethyl)ether;
SF-1 = Alkanol XC ™, Sodium isopropylnapthylsulfonate;
SF-2 = Sodium perfluorooctylsulfonate;
Aux. Solv. = 2-(2-Butoxyethoxy)ethyl acetate.

Sensitometry

Samples of the color paper coatings were exposed for 0.1 second to a 365 nm line from a Hg light source through a 1.0 neutral density filter and a 0 to 3.0 density (D) step tablet (ΔD=0.15) to determine intrinsic (native) speed. To determine speed in the region of spectral sensitization other samples of the same coatings were exposed to light in a Kodak Model 1B sensitometer with a color temperature of 3000° K which was filtered with a combination of a Kodak Wratten™ 2C plus a Kodak Color Compensating™ filter of 85 cc magenta plus a Kodak Color Compensating™ filter of 130 cc yellow. Exposure time was typically adjusted to 0.1 second, except when determining the reciprocity characteristics of the emulsion, in which case it was varied over a range from $1\times10^{-5}$ to 100 seconds. Intrinsic sensitivity exposures were made with a high pressure mercury lamp, appropriately filtered to obtain the characteristic 365 nm emission line. Exposure time was adjusted to be 0.1 sec. The exposures were performed by contacting the paper samples with a neutral, 21 step exposure tablet having an exposure range of 0 to 3 log E in 0.15 log E increments.

After being exposed, the samples were processed in the Kodak Ektacolor RA-4 Color Development Process™ and the resultant dye densities of each exposure step were measured using a reflectance densitometer equipped with the appropriate Status A filters.

Speed was measured by determining the relative log exposure at a 1.0 density point on the characteristic (density vs. log E) curve. Contrast was determined by obtaining the difference between densities at two points on the characteristic curve which were separated by ±0.3 log E from the speed point and dividing the density difference by the log E difference in log exposure (log E) between the two points (0.6).

To determine the heat sensitivity characteristics of the emulsions, samples were exposed for 0.1 second at 40° C. and at 20° C. before processing. The difference in sensitivity (relative log exposure) of the emulsion between these two temperatures describes the heat sensitivity characteristics of the emulsion.

The reciprocity characteristics of the emulsions were measured by exposing samples of each emulsion at different exposure times and correcting for exposure differences with the addition or subtraction of the appropriate Inconel filters. High intensity speed reciprocity (HIRF) was determined as the difference between measured speeds at $10^{-5}$ second and 0.1 second. HIRF that resulted in lower speed at the higher intensity ($10^{-5}$ second) exposure is indicated by a negative value.

The sensitometric results are summarized in Table XXIII.

TABLE XXIII

| Emulsion | 3000° K. RelLog Speed @ 0.1 sec | 365 nm RelLog Speed @ 0.1 sec | γ @ 0.1 sec | HIRF | Heat Sens. Δlog E |
|---|---|---|---|---|---|
| FF (no I, no dopant) | 100 | 100 | 2.96 | −0.58 | 0.305 |
| FF (with KBr sens.) | 168 | 139 | 3.04 | −0.70 | 0.142 |
| GG (I, no dopant) | 195 | 177 | 2.20 | 0.06 | −0.028 |
| HH (I, RuCN, Ir) | 184 | 174 | 2.10 | 0.21 | −0.033 |
| II (I, OsNO, Ir) | 187 | 162 | 2.70 | 0.07 | 0.079 |
| JJ (I, OsNO, RuCN) | 187 | 179 | 2.77 | −0.04 | −0.03 |
| KK (I, OsNO, IrTz) | 168 | 150 | 2.38 | 0.06 | 0.029 |

The 3000° K exposure speeds of the Emulsions GG–KK satisfying the requirements of the invention were from 0.69 to 0.96 log E faster than the control undoped silver chloride emulsion FF. Adding an additional KBr sensitizer increased the speed of the silver chloride emulsion FF by 0.69 log E, equaling the speed of emulsion KK, but failing to reach the speeds of emulsions GG–JJ satisfying the requirements of the invention. The 365 nm line speeds of the example emulsions GG–KK were all faster than that of the AgCl emulsion FF, with or without an additional KBr sensitization.

The emulsions of the invention GG–KK all exhibited lower high reciprocity failure than the AgCl emulsion FF, with or without an additional KBr sensitization. The combination of RuCN and Ir dopants markedly increased the speed of example emulsion HH at the higher intensity exposures. A significant portion of the contrast reduction produced by iodide inclusion was offset by the incorporation of OsNO.

Heat sensitivity was markedly decreased in the emulsions GG–KK satisfying invention requirements as compared to the AgCl emulsion FF, with or without KBr sensitization.

Example 13

This example demonstrates the results obtained by employing a combination of OsNO, RuCN and Ir as dopants in the emulsions satisfying the requirements of the invention.

The following additional emulsions were prepared:

Emulsion LL (control cubic grain AgCl emulsion, RuCN, OsNO and Ir dopants)

Emulsion LL was precipitated in the same manner as emulsion FF, except that a solution of $9.0\times10^{-10}$ mole of $Cs_2OsNOCl5$ per Ag mole was added over a period extending from 0 and 70% of the total silver addition and a solution of $2.5\times10^{-5}$ mole of $K_4Ru(CN)_6$) per Ag mole was added over a period extending from 75 and 80% of the total silver addition and an acidic solution of $2.1\times10^{-9}$ mole of $K_2IrCl6$ per Ag mole was added at over a period extending from 95 and 97% of the total silver addition.

Emulsion MM (example AgICl emulsion, RuCN, OsNO and Ir dopants, 0.3M % I after 93% of Ag)

Emulsion MM was precipitated in the same manner as emulsion GG, except that a solution of $9.0\times10^{-10}$ mole of $Cs_2OsNOCl5$ per Ag mole was added over a period extending from 0 and 70% of the total silver addition, a solution of $2.5\times10^{-5}$ mole of $K_4Ru(CN)_6$) per Ag mole was added over a period extending from 75 and 80% of the total silver addition, and an acidic solution of $2.1\times10^{-9}$ mole of $K_2IrCl6$ per Ag mole was added at over a period extending from 95 and 97% of the total silver addition.

Coating and sensitometry were identical to the descriptions in Example 12, except that no 365 nm Hg line exposures were undertaken. Emulsion LL was additionally sensitized with KBr while Emulsion MM did not receive a KBr sensitization. The. results are summarized in Table XXIV.

TABLE XXIV

| Emulsion | 3000° K. RelLog Speed @ 0.1 sec | γ @ 0.1 sec | HIRF | Heat Sens. Δlog E |
|---|---|---|---|---|
| FF (no I, no dopant) | 100 | 2.96 | −0.58 | 0.305 |
| FF (with KBr sens.) | 168 | 3.04 | −0.70 | 0.142 |
| GG (I, no dopant) | 195 | 2.20 | 0.06 | −0.028 |
| LL (no I, KBr, RuCN, Ir and OsNO) | 147 | 3.41 | 0.13 | 0.04 |
| MM (I, no KBr, RuCN, Ir and OsNO) | 182 | 2.78 | 0.12 | 0.04 |

From Table XXIV it is apparent that the emulsions satisfying the requirements on the invention, Emulsions GG and MM, exhibited higher speeds than the control emulsions, even when the control emulsions received an additional KBr sensitization. By comparing emulsions GG and ME it is apparent that the combination of dopants allowed a higher contrast to be obtained. The OsNO contributed primarily to the increased contrast while the RuCN offset speed reductions that the OsNO would have otherwise produced. The Ir remained effective to reduce HIRF in the presence of both of the other dopants. Hence, the overall performance of Emulsion MM, satisfying the requirements of the invention, was more favorable than that of the remaining emulsions.

The invention has been described in detail with particular reference to certain preferred embodiments thereof, but it will be understood that variations and modifications can be effected within the spirit and scope of the invention.

What is claimed is:

1. A photographic print element comprised of a reflective support and, coated on the support, at least one image recording emulsion layer unit containing a radiation-sensitive emulsion comprised of a dispersing medium and silver iodochloride grains WHEREIN the silver iodochloride grains are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide-free surface shell having a thickness of greater than 50 Å, and a sub-surface shell that contains a maximum iodide concentration.

2. A photographic print element according to claim 1 wherein the grain size coefficient of variation of the silver iodochloride grains is less than 35 percent.

3. A photographic print element according to claim 2 wherein the grain size coefficient of variation of the silver iodochloride grains is less than 25 percent.

4. A photographic print element according to claim 1 wherein the silver iodochloride grains contain from 0.1 to 1.0 mole percent iodide, based on total silver.

5. A photographic print element according to claim 1 wherein the core contains at least 85 percent of total silver.

6. A photographic print element according to claim 1 wherein iodide forming the grains is excluded from the core of the grains.

7. A photographic print element according to claim 6 wherein the core accounts for at least 85 percent of total silver forming the grains.

8. A photographic print element according to claim 1 wherein the emulsion, when exposed to 390 nm electromagnetic radiation at 10° K., exhibits stimulated fluorescent emissions in the range of from 450 to 470 nm and at 500, the stimulated fluorescent emission in the range of from 450 to 470 nm having a peak intensity more than twice the stimulated fluorescent emission intensity at 500 nm.

9. A photographic print element according to claim 1 wherein the silver iodochloride grains include tetradecahedral grains having {111} and {100} crystal faces.

10. A photographic print element according to claim 1 wherein the silver iodochloride grains contain a sensitivity enhancing dopant.

11. A photographic print element according to claim 1 wherein the silver iodochloride grains contain a contrast increasing dopant.

12. A photographic print element according to claim 1 wherein the silver iodochloride grains contain a reciprocity improving iridium dopant.

13. A photographic print element according to claim 1 wherein the emulsion contains as an antifoggant a compound containing a mercapto group bonded to a carbon atom which is linked to an adjacent nitrogen atom in a heterocyclic ring system.

14. A photographic print element according to claim 13 wherein the antifoggant is a 5-mercaptotetrazole.

15. A photographic print element according to claim 14 wherein the 5-mercaptotetrazole is comprised of a tetrazole ring and an aromatic substituent on the tetrazole ring.

16. A photographic print element according to claim 15 wherein the antifoggant is a phenyl substituted 5-mercaptotetrazole, with the phenyl group either being unsubstituted or containing a substituent chosen from among alkoxy, phenoxy, halogen, cyano, nitro, amino, amido, carbamoyl, sulfamoyl, sulfonamido, sulfo, sulfonyl, carboxy, carboxylate, ureido and carbonyl groups.

17. A photographic print element according to claim 1 wherein the emulsion contains as an antifoggant a quaternary aromatic chalcogenazolium salt wherein the chalcogen is sulfur, selenium or tellurium.

18. A photographic print element according to claim 1 wherein the antifoggant is a benzothiazolium salt or a benzoselenazolium salt.

19. A photographic print element according to claim 1 wherein the emulsion contains as an antifoggant a triazole or tetrazole containing an ionizable hydrogen bonded to a nitrogen atom in a heterocyclic ring system.

20. A photographic print element according to claim 1 wherein the emulsion contains as an antifoggant a benzotriazole or a tetraazaindene.

21. A photographic print element according to claim 1 wherein the emulsion contains as an antifoggant a dichalcogenide compound comprising an —X—X- linkage between carbon atoms wherein each X is divalent sulfur, selenium or tellurium.

22. A photographic print element according to claim 1 in wherein a blue sensitive yellow dye image forming layer unit, a green sensitive magenta dye image forming layer unit, and a red sensitive cyan dye image forming layer unit are coated on the reflective support and the emulsion containing the silver iodochloride containing grains is present in at least one of the dye image forming layer units.

23. A photographic print element according to claim 1 wherein the silver iodochoride grains include grains having at least one {111} crystal face.

* * * * *